United States Patent [19]

Inoue et al.

[11] Patent Number: 4,996,137

[45] Date of Patent: Feb. 26, 1991

[54] METHOD FOR FORMING A DIRECT POSITIVE IMAGE

[75] Inventors: Noriyuki Inoue; Katsumi Hirano; Mitsuo Saitou, all of Kanagawa, Japan

[73] Assignee: Fuji Photo Film Co., Ltd., Kanagawa, Japan

[21] Appl. No.: 541,170

[22] Filed: Jun. 21, 1990

Related U.S. Application Data

[63] Continuation of Ser. No. 236,100, Aug. 24, 1988, abandoned.

[30] Foreign Application Priority Data

Aug. 24, 1987 [JP] Japan ..... 62-208241

[51] Int. Cl.[5] ..... G03C 5/24

[52] U.S. Cl. ..... 430/378; 430/406; 430/409; 430/410; 430/547; 430/567; 430/598

[58] Field of Search ..... 430/378, 547, 567, 409, 430/410, 406, 598

[56] References Cited

U.S. PATENT DOCUMENTS 3,935,014 1/1976 Klötzer et al. ..... 430/567
4,594,317 6/1986 Sasaki et al. ..... 430/567
4,789,627 12/1988 Inone et al. ..... 430/406
4,797,354 1/1989 Saiton et al. ..... 430/569

*Primary Examiner*—Paul R. Michl
*Assistant Examiner*—Thorl Chea
*Attorney, Agent, or Firm*—Sughrue, Mion, Zinn, Macpeak & Seas

[57] ABSTRACT

A method for forming a direct positive image composed of the step of developing with a surface developer an imagewise exposed photosensitive material compose of support having thereon at least one photosensitive emulsion layer containing unprefogged silver halide grains capable of forming an internal latent image; the at least the photosensitive emulsion layer composed of hexagonal tabular silver halide grains in an amount of at least 30 wt %, based on the total silver amount of silver halide grains therein; the hexagonal tabular grains having two parallel hexagonal faces, the ratio of the longest side to the shortest side of the hexagon being at most 2; the aspect ratio of the hexagonal tabular grains being from 2 to 8; and the hexagonal tabular grains having a monodisperse size distribution. The method provides increases in processing speed, maximum density, and contrast in the toe portion, and an improvement in graininess, even when exhausted processing solutions are used.

15 Claims, No Drawings

METHOD FOR FORMING A DIRECT POSITIVE IMAGE

This a continuation of application Ser. No. 07/236,100, filed Aug. 24. 1988, now abandoned.

FIELD OF THE INVENTION

The present invention relates to a method of forming a direct positive image which utilizes an unprefogged silver halide emulsion of internal latent image type.

BACKGROUND OF THE INVENTION

Photographic processes according to which direct positive images can be obtained without requiring reversal processing or negative film are well-known.

As for the method of forming a direct positive image utilizing a silver halide emulsion of internal latent image type, various methods are known, such as those described in U.S. Pat. Nos. 2,592,250, 2,466,957, 2,497,875, 2,588,982, 3,317,322, 3,761,266, 3,761,267 and 3,796,577, British Patents 1,151,363, 1,150,553 and 1,011,062.

In order to form a direct positive image, an internal latent image type silver halide photosensitive material is processed with a surface color developer after or while receiving a fogging treatment, and then subjected to bleach processing and fixation processing (or a bleach-fix processing). After fixation, the photosensitive material is usually subjected to a washing and/or stabilizing treatment.

In the formation of direct positive image using an optical or chemical fogging method, it takes a long time to complete the photographic processing because of a low developing rate, compared with the formation of ordinary negative images. Therefore, a method of increasing the pH and/or the temperature of a developer used has so far been adopted as a measure for shortening the processing time. However, such a method has a problem that a high pH of the developer generally causes an increase in the minimum image density of the direct positive image formed. In addition, deterioration of the developing agent attributable to aerial oxidation and a lowering of pH caused by adsorption of carbon dioxide gas in the air tend to occur under high pH conditions, and thereby the developing activity of the developer is markedly lowered. Another problem is that the development processing performed under high temperatures causes, in general, a decrease in contrast of the positive image produced, especially in the toe portion thereof.

Other methods for increasing the developing rate in the formation of a direct positive image include the utilization of hydroquinone derivatives (as described in U.S. Pat. No. 3,227,552), and the utilization of mercapto compounds containing a carboxylic or sulfonic acid group (as described in JP-A-60-170843 (the term "JP-A" as used herein means an "unexamined published application")). However, the effects produced by using such compounds are small. Under these circumstances, methods of effectively heightening the maximum density of direct positive images without increasing their minimum densities romain to be found. In particular, a method providing a sufficiently high maximum density even by processing with a low pH developer is desired.

Moreover, increase of the development time in photographic processing of direct positive photosensitive materials of internal latent image type has the problem that the contrast in the toe portion of the produced images tends to be decreased. In this respect, methods of increasing developing rate are desired.

Instant color photography (or color forming material transfer process) can provide a positive image in a short time and here also, a reduction of development time is desired.

Direct positive photosensitive materials further have the deficiency that they are inferior to conventional negative photosensitive materials in sharpness and graininess of the produced images. In particular, this defect becomes remarkable when the oxidation of a developing agent in the developer, a lowering of pH, an increase in bromine ion concentration and so on occur in running processing to deteriorate the developer, or the photosensitive materials are stored for a long time under severe conditions. Accordingly, methods achieving satisfactory sharpness and graininess even by the use of a low pH developer are desired.

A method utilizing an internal latent image type emulsion which contains tabular silver halide grains having a grain thickness less than 0.5 $\mu$m, a grain diameter of 0.6 $\mu$m or more and an aspect ratio of 8 or more is described in JP-A-58-108528, which brings about an improvement in sharpness and graininess of the produced images. However, the improvement is still insufficient. Also, this method has a small effect on the heightening of the maximum image density without being attended by an increase of the minimum image density, and on an increase in developing rate. Further, an increase in contrast in the toe portion of the image is not obtained by this method.

Japanese Patent Application No. 299155/86 discloses that a silver halide emulsion containing monodisperse, hexagonal, tabular silver halide grains has effects on enhancement of the sensitivity in color sensitization, improvement of the image sharpness and lowering of the intrinsic sensitivity, but does not contain any description of methods for forming direct positive images. In addition, high sensitivity and low re-reversal sensitivity are described in an example of the foregoing patent specification wherein the monodisperse, hexagonal, tabular silver halide grains are applied to color instant photography and the aspect ratio of the grains used is 11.3.

SUMMARY OF THE INVENTION

An object of the present invention is to provide a method of forming a direct positive image which enables an increase of the maximum density without increasing the minimum density, and ensures a rapid progress of development.

Another object of the present invention is to provide a method of forming a direct positive image having excellent sharpness.

Still another object of the present invention is to provide a method of forming a direct positive image having excellent graininess even when the development processing is performed with a developer deteriorated by running processing.

A further object of the present invention is to provide a method of forming a direct positive image which is contrasty in the toe portion.

Another object of the present invention is to provide a method of forming an instant color positive image which ensures high reversal sensitivity, low rereversal sensitivity and low minimum image density.

It has now been found that these and other objects of the present invention are effectively attained with a method for forming a direct positive image comprising the step of developing with a surface developer an imagewise exposed a photosensitive material composed of a support having thereon at least one photosensitive emulsion layer containing unprefogged silver halide grains capable of forming an internal latent image; the at least one photosensitive emulsion layer containing hexagonal tabular silver halide grains in an amount of at least 30 wt %, preferably at least 50 wt %, more preferably at least 70 wt %, based on the total silver amount of silver halide grains therein; the hexagonal tabular grains having two parallel hexagonal faces, the ratio of the longest side to the shortest side of the hexagon being at most 2, preferably at most 1.5 and the aspect ratio of said hexagonal tabular grains being from 2 to 8, preferably from 3 to 8, more preferably from 5 to 8; and the hexagonal tabular grains having a monodisperse size distribution.

DETAILED DESCRIPTION OF THE INVENTION

The unprefogged, internal latent image type silver halide emulsion to be employed in the present invention contains silver halide grains whose surfaces are not prefogged, and which form the latent image predominantly in the interior thereof. More specifically, as used herein the term is defined as an emulsion capable of exhibiting at least a 5-fold, and preferably at a least a 10-fold, maximum density when a silver halide emulsion is coated on a transparent support at a prescribed coverage (e.g. about 0.5 to about 3 g/m$^2$ based on silver), exposed to light for a fixed period of time (e.g. about 0.01 to about 10 sec.), and then developed at 18° C. for 5 min. using the developer A described below (internal developer), and thereafter the maximum density is determined according to a conventional photographic density measuring method, compared with the case where the silver halide emulsion coated at the same coverage is exposed in the same manner, and developed at 20° C. for 6 minutes using the developer B described below (surface developer B).

| | |
|---|---|
| Internal Developer A | |
| Metol | 2 g |
| Sodium Sulfite (anhydrous) | 90 g |
| Hydroquinone | 8 g |
| Sodium Carbonate (monohydrate) | 52.5 g |
| KBr | 5 g |
| KI | 0.5 g |
| Water to make | 1 l |
| Surface Developer B | |
| Metol | 2.5 g |
| L-ascorbic Acid | 10 g |
| $NaBO_2.4H_2O$ | 35 g |
| KBr | 1 g |
| Water to make | 1 l |

Direct positive emulsions tend to undergo infectious development, compared with negative emulsions, and consequently they tend to cause the deterioration of graininess. Therefore, a more remarkable improvement effect on graininess can be achieved in direct positive emulsions than negative ones.

Details of the structure and the preparation methods of the monodisperse, hexagonal, tabular silver halide grains to be employed in the present invention are provided in Japanese Patent Application No. 299155/86. The silver halide emulsion containing these grains is specifically a silver halide emulsion constituted with silver halide grains and a dispersion medium, in which 30 wt % or more, preferably 50 wt % or more, more preferably 70 wt % or more, of silver halide grains, based on the total silver amount, have a hexagonal tabular form in which two parallel outer faces are present, and the shape of the faces is a hexagon such that a ratio of the longest side to the shortest one is 2 or less, preferably 1.5 or less. Further, the above-described hexagonal tabular silver halide grains have a monodisperse size distribution and an aspect ratio ranging from 2 to 8, preferably from 3 to 8, more preferably from 5 to 8.

Preferred monodisperse systems in the present invention are emulsions which have a variation coefficient of 20% or less, more preferably 15% or less, and particularly preferably 10% or less, as the size distribution of the hexagonal tabular silver halide grains (the term "variation coefficient" of grain size distribution as used herein refers to a value determined by dividing the standard deviation of grain sizes corresponding to the diameter of a circle having the projected area by their average grain size).

Although tabular silver halide grains having such monodispersibility as to have a variation coefficient of about 30% or less are described in the foregoing JP-A-58-108528, the aspect ratio of these grains is larger than 8:1, as described above, and the crystal form of the grains is different from the hexagonal tabular form defined in the present invention. In addition, monodispersibility with a variation coefficient of about 30% or less can only make an insufficient contribution to the increase of developing rate and to improvements upon sharpness and graininess of images to be produced. Therefore, as described above, it is desired that the hexagonal tabular silver halide grains of the present invention should have monodispersibility with a variation coefficient of 20% or less.

In addition, the aspect ratio of the hexagonal tabular silver halide grains used in the present invention must range from 2 to 8, preferably from 3 to 8, more preferably from 5 to 8. Aspect ratios less than 2 are undesirable since the progress of development is slowed to bring about insufficient improvements of sharpness and graininess of the positive images. On the other hand, aspect ratios larger than 8 are also undesirable, for they cause an increase in the minimum density of positive images obtained.

The average grain size (corresponding to the diameter of a circle having the average projected area) of the silver halide grains of the present invention ranges preferably from 0.2 to 2.5 microns, more preferably from 0.2 to 2.0 microns.

The composition of the hexagonal tabular grains may be any of silver bromide, silver iodobromide, silver chlorobromide and silver chloroiodobromide. In the silver iodobromine, the iodide content is within the range of about 0 to about 30 mol %, preferably 0 to 10 mol %, and more preferably 0 to 5 mol %. In the silver chloroiodobromide, the iodide content ranges from about 0 to about 10 mol %, preferably 0 to 5 mol %, and the chloride content ranges from about 0 to about 80 mol %, preferably from 0 to 50 mol %.

Of these halide compositions, bromide and chlorobromides are preferred.

The foregoing silver halide grains are prepared via nucleation, Ostwald ripening and grain growth steps, as described in Japanese Patent Application No. 299155/86.

It is preferred that the silver halide grains to be used in the present invention have a core/shell structure. For the details of methods for the shell formation, Example 13 of Japanese Patent Application No. 299155/86, and U.S. Pat. Nos. 3,761,276, 4,269,927 and 3,367,778 can be referred to. Silver halides usable in the shell formation include silver bromide, silver iodobromide, silver chloride, silver chlorobromide, and silver chloroiodobromide. The molar ratio of silver halide which constitutes the core to silver halide which constitutes the shell ranges preferably from 1/30 to 5/1, more preferably from 1/20 to 2/1, and particularly preferably from 1/20 to 1/1, based on silver.

In the internal latent image type emulsion, especially the core/shell emulsion, it is important to thoroughly cover the core with the shell, because an increase in Dmin (minimum density) takes place even when only a part of the core surface is uncovered.

Also, the silver halide grains employed in the present invention may be those prepared by using the hexagonal tabular grains defined in the present invention as host grains, and making guest grains having various halide compositions by epitaxial growth. As for the epitaxial growth of the guest grains, descriptions in JP-A-58-108526, JP-A-57-133540 and JP-A-62-32443 can be referred to.

Further, in a process of forming the silver halide grains to be used in the present invention, or allowing the formed silver halide grains to ripen physically, compounds of cadmium, zinc, lead, thallium, copper, bismuth, gold and the group VIII metals may be present. Such compounds may be placed in the reaction container from the first, or they may be added simultaneously with the addition of one or more of salts according to conventional methods. Details of the addition of the above-described compounds are described in U.S. Pat. Nos. 1,195,432, 1,951,933, 2,448,060, 2,628,167, 2,950,972, 3,488,709, 3,737,313, 3,772,031 and 4,269,927, and *Research Disclosure,* volume 134, item 13462 (June 1975). (*Research Disclosure* and its antecedent *Product Licensing Index* are the publications of Industrial Opportunities Limited, Herband, Homewel, Hampshire, P09-1EF, United Kingdom.

As described in Moiser, et al., *Journal of Photographic Science,* volume 25, pages 19–27 (1977), the monodisperse hexagonal tabular grains can be subjected to internal reduction sensitization in the process of precipitating the grains.

The hexagonal tabular grains to be used in the present invention may have dislocation lines in the interior thereof. Whether dislocation lines are present or not, and how many lines are present, can be judged by observation under a low temperature (liquid He temperature) transmission electron microscope.

The hexagonal tabular grains having dislocation lines inside thereof can be formed by adding an iodide for a certain period at the stage of the crystal growth of the hexagonal tabular grains or at the stage where the crystal growth occurs on the seed crystals having the hexagonal tabular form. The expression "a certain period" in this case includes from a moment (about ½ second) to the whole grain-growth period. The dislocation lines are formed when the iodide is added at such a rate that a difference between the iodide content in the silver iodobromide precipitated by the addition and that in the silver iodobromide present as the substrate is about 5 mol % or more.

One example of the production process for the hexagonal tabular silver halide emulsion of the present invention is explained below.

(1) Nucleus Formation:

The nucleus formation is performed by adding an aqueous solution of a water-soluble silver salt and an aqueous solution of an alkali halide to an aqueous solution containing a dispersion medium while keeping pBr at 1.0 to 2.5.

(2) Ripening:

In the nucleus formation described above in 1), fine tabular grain nuclei are formed and at the same time many other fine grains (in particular, octahedral and single twin grains) are formed. It is necessary to extinguish grains other than tabular grain nuclei before entering the growing step described below, in order to provide nuclei having shapes suitable for forming tabular grains and good monodispersibility. For enabling the aforesaid procedure, it is known to perform Ostwald ripening subsequent to the nucleus formation. Since the Ostwald ripening proceeds slowly at low temperature, from the viewpoint of actual use, it is required to perform the ripening at about 40° C. to about 80° C., and preferably 50° C. to 80° C. In the ripening process, the fine octahedral grains and the single twin fine grains are dissolved and deposited on the tabular nuclei, whereby the existing ratio of tabular grains is increased.

(3) Growing:

In the crystal grain growing subsequent to the ripening step, it is preferred that for a period of at least the first ⅓ of the grain growing period, the pBr value is kept at 1.8 to 3.5, and for a period of at least the first ⅓ of the remainder of the grain growing period, the pBr value is kept at from 1.5 to 3.5. Also, it is preferred that the addition rates of silver ion and halogen ion in the crystal growing period are controlled in such a manner that the crystal growing rate becomes from 20 to 100%, and particularly preferably from 30 to 100%, of the critical crystal growing rate. In this case, the addition rates of silver ion and halogen ion are increased with the growth of silver halide crystals and as a manner of increasing the addition rates, the addition rate (flow rates) of an aqueous silver salt solution and an aqueous halide solution each having a constant concentration may be increased or the concentrations of an aqueous silver salt solution and an aqueous halide solution may be increased as described in JP-B-48-36890 and JP-B-52-16364. Also, a very fine grain silver halide emulsion having grain sizes of up to about 0.10 μm is previously prepared and the very fine grain emulsion may be added thereto with an increased addition rate.

Details of spectral sensitizing dyes, antifoggants, stabilizers, chemical sensitizers and chemical sensitizing processes, dispersion media, hardeners, dimensional stability improving agents, antistatic agents, coating aids, dyes, color couplers, adhesion inhibitors, photographic characteristic improvers (e.g., development accelerators, contrast increasing agents and sensitizers), which can be added to the silver halide emulsion used in the present invention, and their usages are described in *Research Disclosure,* volume 176, item 17643 (December 1978), JP-A-58-113926, JP-A-58-113927, JP-A-58-113928 and JP-A-59-90842.

In particular, spectral sensitizing dyes, antifoggants and stabilizers can be added at any stage in the process of producing the photographic emulsion, and further can be added at any period from after the production of the photographic emulsion to just before the coating thereof. The process of producing the photographic emulsion includes the stage of forming silver halide grains, that of ripening the grains physically, and that of ripening them chemically. More specifically, spectral sensitizing dyes, antifoggants and stabilizers used not only for conventional purposes but also, by taking advantage of their strong adhesion to emulsions and other properties, for the purposes of restricting the positions at which chemically sensitized nuclei are to be formed and preventing excess halogen conversion upon formation of grains having a junction structure, wherein phases differing in halogen composition are conjoined, to preserve the junction structure. For details of the above-described additional functions, JP-A-55-26589, JP-A-58-111935, JP-A-58-28738 and JP-A-62-7040, and U.S. Pat. Nos. 3,628,960 and 4,225,666 can be referred to.

When some portions or the whole amounts of spectral sensitizing dyes, antifoggants and stabilizers used are added prior to the addition of chemical sensitizers, and then chemical ripening is performed by the addition of chemical sensitizers, the positions at which chemically sensitized nuclei are formed on the silver halide grains are restricted to the sites at which none of the sensitizing dyes, the antifoggants and stabilizers are adsorbed. Such being the case, latent image dispersion can be prevented, and a desirable effect of enhancing photographic characteristics can be gained. In particular, addition of such sensitizing dyes, antifoggants and stabilizers selectively adsorbed to the (111) face of the silver halide grains can bring about good results, because chemically sensitized nuclei are formed only along the edge of the hexagonal tabular grains.

In general, the foregoing additives are preferentially adsorbed to crystal faces forming the main surfaces of the tabular grains, and thereby chemically sensitized nuclei are produced at different crystal faces of individual tabular grains.

The chemical sensitization can be effected by using active gelatin as described in T. H. James, *The Theory of The Photographic Process,* 4th ed., pp. 67–76, (Macmillan 1977), and also by using a sulfur, selenium, tellurium, gold, platinum, palladium, iridium, osmium, rhodium, rhenium or phosphorus sensitizer, or a combination of two or more thereof under conditions of pAg about 5–10, pH about 5–8 and a temperature ranging from about 30° C. to about 80° C. as described in *Research Disclosure,* volume 120, item 12008 (April 1974), id volume 134, item 13452 (June 1975), U.S. Pat. Nos. 1,623,499, 1,673,522, 2,399,083, 2,642,361, 3,297,447, 3,297,446, 3,772,031, 3,761,267, 3,857,711, 3,565,633, 3,901,714 and 3,904,415, and British Patents 1,315,755 and 1,396,696. It is most appropriate to carry out the chemical sensitization in the presence of thiocyanate compounds as described in U.S. Pat. No. 2,642,361, or sulfur-containing compounds as described in U.S. Pat. Nos. 2,521,926, 3,021,215 and 4,054,457. Further, the silver halide grains can be chemically sensitized in the presence of a finish (chemical sensitization) modifier. Examples of a finish modifier which can be used include compounds known to be capable of depressing fog and enhancing sensitivity in the process of chemical sensitization, such as azaindenes, azapyridazines, azapyrimidines, benzothiazolium salts, and sensitizers having one or more heterocyclic nuclei. Specific examples of such finish modifiers are described in U.S. Pat. Nos. 2,131,038, 3,411,914, 3,554,757, 3,565,631 and 3,901,714, Canadian Patent 778,723, and G. F. Duffin, *Photographic Emulsion Chemistry,* pp. 138–143 (Focal Press, New York 1966). In addition to or as substitution for chemical sensitization, reduction sensitization with, e.g., hydrogen as described in U.S. Pat. Nos. 3,891,446 and 3,984,249, or a reducing agent such as stannous chloride, thiourea dioxide, a polyamine or amine borane, as described in U.S. Pat. No. 2,983,609, Oftedarl et al., *Research Disclosure,* volume 136, item 13654 (August 1975), and U.S. Pat. Nos. 2,519,689, 2,739,060, 2,743,182, 2,743,183, 3,026,203 and 3,361,564, or by treatment under a low pAg value (e.g., below about 5) and/or a high pH value (e.g., above about 8) can be performed. Moreover, surface chemical sensitization including the sensitization beneath the grain surface as described in U.S. Pat. Nos. 3,917,485 and 3,966,476 can be carried out.

Also, it is effective to perform the chemical sensitization in the presence of a silver halide solvent. Suitable examples of silver halide solvents which can be used include thiocyanates and solvents described in Japanese Patent Application No. 299155/86. Such a solvent is preferably used in a concentration ranging from $10^{-5}$ to $10^{-1}$ mol/l.

In combination with either or both of the foregoing techniques, or independently thereof can be employed a third technique which involves the introduction of a silver salt capable of producing precipitates on the grain surfaces, such as silver thiocyanate, silver phosphate, silver carbonate or the like, and a soluble silver salt such as silver acetate, silver trifluoroacetate or silver nitrate, and fine silver halide grains capable of undergoing Ostwald ripening on the tabular grain surfaces (namely, silver bromide, silver iodide and/or silver chloride) just before or during the chemical sensitization. For example, Lipman emulsion can be introduced in the process of chaemical sensitization.

Furthermore, the silver halide emulsion employed in the present invention may be of the type which can be spectrally sensitized with antenna dyes. For details of the spectral sensitization with antenna dyes the descriptions in JP-A-62-209532 can be referred to.

The silver halide emulsion of the present invention can be provided on a support in the form of single layer or multilayer (e.g., double layer, triple layer or so on), if necessary, together with other emulsions. Also, it can be provided on both sides of the support, as well as on one side. Moreover, it can contain emulsions differing in color sensitivity, and they can be layered over one another.

Details of color couplers which can be used in the present invention are described on pages 19 to 27 in JP-A-63-81337, and various compounds which can be added to the photosensitive material of the present invention (e.g., color fog inhibitors, discoloration inhibitors, dyes and so on) are described on pages 28 to 30 in the above-cited patent specification.

The present invention can also be applied to a multilayer multicolor photographic material having at least two layers differing in color sensitivity on a support. A multilayer natural color photographic material has, in general, at least one red-sensitive emulsion layer, at least one green-sensitive emulsion layer and at least one blue-sensitive emulsion layer on a support. The order of these layers can be varied as desired. However, it is preferred that red-, green- and blue-sensitive emulsion layers, or green-, red- and blue-sensitive emulsion layers are arranged in that order from the support. Further, each of the above-described emulsion layers may contain at least two layers differing in sensitivity, and a light-insensitive layer may be present between two or more emulsion layers having the same color sensitivity. Usually, cyan-, magenta- and yellow-forming couplers are incorporated in red-, green- and blue-sensitive emulsion layers, respectively. However, different combinations can also be employed, if desired.

In addition to the silver halide emulsion layers, it is desirable that the sensitive material used in the present invention contains auxiliary layers such as a protective layer, an interlayer, a filter layer, antihalation layer, a backing layer and a white reflection layer.

In the photographic light-sensitive material used in the present invention, photographic emulsion layers and other layers are coated on a support as described in *Research Disclosure,* No. 17643, XVII, page 28 (December 1978), European Patent 0,182,253, and JP-A-61-97655. Coating methods as described in *Research Disclosure,* No. 17643, XV, pages 28–29 can be used.

The present invention can be applied to various kinds of color photosensitive materials.

Representative photosensitive materials are color reversal films for slide and television uses, and color reversal paper. Further, the present invention can be applied to color hard copies for preservation of images of full color copying machines or CRT. Furthermore, it can be applied to black-and-white photosensitive materials utilizing a three color coupler mixing process as described in *Research Disclosure,* No. 17123 (July 1978).

Also, the present invention can be applied to photosensitive materials for a color diffusion transfer process. In this case, diffusible dye-releasing redox compounds are used to advantage as color materials. The diffusible dye-releasing redox compounds (which are abbreviated as "DDR compounds" hereinafter) can be represented by formula:

(Ballast group)(redox-cleavable atomic group)D wherein D represents a dye moiety (or a precursor thereof), which may be attached to the redox-cleavable atomic group via a linkage group.

As for the dye moiety represented by D, those described in the following publications are effective.

Examples of Yellow-Dyes:

U.S. Pat. Nos. 3,597,200, 3,309,199, 4,013,633, 4,245,028, 4,156,609, 4,139,383 4,195,992, 4,148,641, 4,148,643 and 4,336,322; JP-A-51-114930 and JP-A-56-71072; and *Research Disclosure,* No. 17630 (December 1978) and No. 16475 (December 1977).

Examples of Magenta Dyes:

U.S. Pat. Nos. 3,453,107, 3,544,545, 3,932,380, 3,931,144, 3,932,803, 3,954,476, 4,233,237, 4,255,509, 4,250,246, 4,142,891, 4,207,104 and 4,287,292; and JP-A-52-106727, JP-A-53-23628, JP-A-55-36804, JP-A-56-73057, JP-A-56-71060 and JP-A-55-134.

Examples of Cyan Dyes:

U.S. Pat. Nos. 3,482,972, 3,929,760, 4,013,635, 4,268,625 4,171,220, 4,242,435, 4,142,891, 4,195,994, 4,147,544 and 4,148,642; British Patent 1,551,138; JP-A-54-99431, JP-A-52-8827, JP-A-53-47823, JP-A-53-143323, JP-A-54-99431 and JP-A-56-71061, European Patents 53,037 and 53,040; and *Research Disclosure,* No. 17630 (December 1978) and No. 16475 (December 1977).

Appropriate coverages of the above-described compounds are each about $1\times10^{-4}$ to about $1\times10^{-2}$ mole/m$^2$, preferably $2\times10^{-4}$ to $2\times10^{-2}$ mole/m$^2$.

In the present invention, color-forming materials may be incorporated in silver halide emulsion layers associating therewith, respectively, or layers adjacent to such emulsion layers, which may be located on the exposure side or the opposite side thereof.

When the photosensitive material used in the present invention is applied to a color diffusion transfer process, the photographic emulsions may be coated on the same support as the image-receiving layers to form an integral unit, or they may be coated on a support different from the one on which image-receiving layers are coated. Silver halide photographic emulsion layers (light-sensitive element) may be provided in a combined form as a film unit, or as separate, independent photographic materials. A film unit may have an integrated structure throughout processing including exposure, development and observation of transferred images, or may have a structure of the type in which the above-described two elements are peeled apart after development. The film unit structure of the latter type is more effective for the present invention.

In addition, the present invention can be applied to black-and-white photographic light-sensitive materials.

Examples of black-and-white (B/W) photographic light-sensitive materials to which the invention can be applied, include B/W direct positive photographic light-sensitive materials described in JP-A-59-208540 and JP-A-60-260039 (e.g., X-ray sensitive materials, duplicate photosensitive materials, micro photosensitive materials, photo-composing sensitive materials, photosensitive materials for graphic arts, and so on).

After imagewise exposure, the photosensitive material in the present invention is developed with a surface developer containing an aromatic primary amine color developing agent after or simultaneously with a fogging treatment with light or a nucleating agent, and then is bleached and fixed, thus forming direct positive color images.

As described above, the fogging treatment in the present invention may be carried out in accordance with an "optical fogging process," in which a second exposure is given to the whole surface of the sensitive layer, or a "chemical fogging process," in which development is carried out in the presence of a nucleating agent. The development processing may be carried out in the presence of both nucleating agent and fogging light. Also, the sensitive material in which a nucleating agent is incorporated may be submitted to fogging exposure. Preferably, the chemical fogging process, in which development processing is performed in the presence of a nucleating agent, is employed in the present invention.

The optical fogging processes are specifically described in JP-A-63-81337, from the 17th line, page 33 to the last line, page 35.

The nucleating agents usable in the present invention include all of the conventional compounds for the purpose of nucleation of internal latent image type silver halides. Two or more kinds of nucleating agents may be used in combination. Specifically, compounds described in *Research Disclosure,* No. 22534, pp. 50–54 (January 1983), id, No. 15162, pp. 76–77 (November 1976) and id, No. 23510, pp. 346–352 (November 1983) can be used as nucleating agents. These are roughly divided into three main groups, quaternary heterocyclic compounds (represented by formula (N-I)), hydrazine compounds (represented by formula (N-II)), and the others.

(N-I)

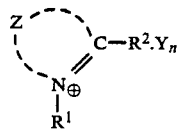

In formula, Z represents a substituted or unsubstituted nonmetallic atomic group necessary for forming a 5- or 6-membered ring. $R^1$ represents an aliphatic group. $R^2$ represents hydrogen, an aliphatic group or an aromatic group. The groups represented by $R^1$ and $R^2$ may be substituted. However, at least one of the groups represented by $R^1$, $R^2$ and Z must contain an alkinyl group, an acyl group, a hydrazinyl group or a hydrazonyl group, or $R^1$ and $R^2$ must be linked to form a 6-membered ring thereby to form a dihydropyridinium ring. Further, at least one of the substituent groups by which $R^1$, $R^2$ and Z may be substituted may have $X^1-(L^1)_m-$. Herein, $X^1$ is a group capable of accelerating the adsorption to silver halide, $L^1$ is a divalent linking group, and m is 0 or 1. Y represents a counter ion required for charge balance. n is 0 or 1.

More specifically, the heterocyclic rings completed by Z include quinolinium, benzothiazolium, benzimidazolium, pyridinium, thiazolinium, thiazolium, naphthothiazolium, selenazolium, benzoselenazolium, imidazolium, tetrazolium, indolenium, pyrrolinium, acridinium, phenanthridinium, isoquinolinium, oxazolium, naphthoxazolium, naphthopyridinium, and benzoxazolium nuclei. Examples of substitutents by which Z can be substituted include an alkyl group, an alkenyl group, an aralkyl group, an aryl group, an alkinyl group, a hydroxyl group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carboxylate group, a hydrazinyl group, a hydrazonyl group, and an imino group. Z may be substituted by at least one group selected from the above-cited groups, and when the number of substitutents is two or more, the substitutents may be the same or different. The foregoing substituent groups may further be substituted by one or more of the same substitutents.

Moreover, Z may be substituted with heterocyclic quaternary ammonium group completed by Z, linked via an appropriate linkage group L. In this case, the compound (N-I) has a dimer structure.

Preferred examples of the heterocyclic group completed by Z include quinolinium, benzothiazolium, benzimidazolium, pyridinium, acridinium, phenanthridinium, naphthopyridinium and isoquinolinium nuclei. Among these nuclei, more preferred are quinolinium, benzothiazolium and naphthopyridinium nuclei, and most preferred is a quinolinium nucleus.

The aliphatic groups represented by $R^1$ and $R^2$ include unsubstituted alkyl groups having 1 to 18 carbon atoms and substituted alkyl groups whose alkyl moieties have 1 to 18 carbon atoms. Examples of groups by which these alkyl groups can be substituted include those named as the substituent groups of Z.

The aromatic group represented by $R^2$ contains 6 to 20 carbon atoms, and specifically includes a phenyl group and a naphthyl group. Examples of groups by which the aromatic group can be substituted include those named as the substituent group of Z.

The foregoing aliphatic groups are preferred as $R^2$, and the most preferable ones are methyl and substituted methyl groups.

As described above, at least one group among $R^1$, $R^2$ and Z contains an alkinyl, acyl, hydrazinyl or hydrazonyl group, or $R^1$ and $R^2$ are linked to form a 6-membered ring thereby to form a dihydropyridinium ring, and these groups may be substituted by those named as the substituent groups of Z. As for the hydrazinyl group, those containing an acyl or sulfonyl group as a substituent are preferred. As for the hydrazonyl group, those containing an aliphatic or aromatic group as a substituent are preferred. As for the acyl group, a formyl group, an aliphatic or aromatic ketone are preferred.

The case where at least one among the substituent groups by which the group or ring represented by $R^1$, $R^2$ and Z is substituted is an alkinyl or acyl group, the case where $R^1$, $R^2$ and Z represent an alkinyl or acyl group, and the case where $R^1$ and $R^2$ combine with each other to form a hydropyridinium ring are preferred. In particular, the case where at least one alkinyl group is present is favored over others.

Preferred examples of an adsorption accelerating group to silver halide represented by $X^1$ include thioamido, mercapto and 5- or 6-membered heterocyclic groups. These groups may be substituted by groups named as substituent groups for Z. As for the thioamido group, preferred are acyclic thioamido groups (such as thiourethane or thioureido).

As for the mercapto group represented by $X^1$, heterocyclic mercapto groups (e.g., 5-mercaptotetrazolyl, 3-mercapto-1,2,4-triazolyl and 2-mercapto-1,3,4-thiadiazolyl) are particularly preferred.

The 5- or 6-membered nitrogen-containing heterocyclic group represented by $X^1$ includes those containing N, O, S and/or C, preferably those capable of producing iminosilver, such as a benzotriazolyl group.

The divalent linking group represented by $L^1$ is an atom or atomic group containing at least one of C, N, S and O. Specific examples thereof include an alkylene group, an alkenylene group, an alkinylene group, an arylene group, —O—, —S—, —NH—, —N=, —CO—, —$SO_2$— (which each may be substituted), and combinations of two or more of these groups.

Examples of the counter ion Y for charge balance include a bromine ion, chlorine ion, iodine ion, p-toluenesulfonic acid ion, ethylsulfonic acid ion, perchloric acid ion, trifluoromethanesulfonic acid ion, and thiocyanic acid ion.

Examples of the foregoing compound and synthesis methods thereof are described, e.g., in the patents quoted in *Research Disclosure*, No. 22534, pp. 50–54 (January 1983) and id, No. 23213, pp. 267–270 (August 1983), JP-B-49-38164, JP-B-52-19452 and JP-B-52-47326 (The term "JP-B" as used herein means an "examined Japanese patent publication"), JP-A-52-69613, JP-A-52-3426, JP-A-55-138742 and JP-A-60-11837, and U.S. Pat. Nos. 4,306,016 and 4,471,044.

Specific examples of the compound represented by formula (N-I) are described below. However, the invention is not to be construed as being limited to these examples.

(N-I-1) 5-Ethoxy-2-methyl-1-propargylquinolium bromide (N-I-2) 2,4-Dimethyl-propargylquinolinium bromide
(N-I-3) 2-Methyl-1-{3-[2-(4-methylphenyl)hydrazono]-butyl}quinolinium iodide
(N-I-4) 3,4-Dimethyl-dihydropyrido[2,1-b]benzothiazolium bromide
(N-I-5) 6-Ethoxythiocarbonylamino-2-methyl-1-propargylquinolinium trifluoromethanesulfonate
(N-I-6) 2-Methyl-6-(3-phenylthioureido)-1-propargylquinolinium bromide
(N-I-7) 6-(5-Benzotriazolylcarboxamido)-2-methyl-1-propargylquinolinium trifluoromethanesulfonate
(N-I-8) 6-[3-(2-Mercaptoethyl)ureido]-2-methyl-1propargylquinolinium trifluoromethanesulfonate
(N-I-9) 6-{3-[3-(5-Mercapto-1,3,4-thiadiazole-2-ylthio)propyl]ureido}-2-methyl-1-propargylquinolinium trifluoromethanesulfonate
(N-I-10) 6-(5-Mercaptotetrazole-1-yl)-2-methyl-1-propargylquinolium iodide
(N-I-11) 1-Propargyl-2-(1-propenyl)quinolinium trifluoromethanesulfonate
(N-I-12) 6-Ethoxythiocarbonylamino-2-(2-methyl-1-propenyl)-1-propargylquinolinium trifluoromethanesulfonate
(N-I-13) 10-Propargyl-1,2,3,4-tetrahydroacridinium trifluoromethanesulfonate
(N-I-14) 7-Ethoxythiocarbonylamino-10-propargyl-1,2,3,4-tetrahydroacridinium trifluoromethanesulfonate
(N-I-15) 6-Ethoxythiocarbonylamino-1-propargyl-2,3-pentamethylenequinolinium trifluorometh-anesulfonate
(N-I-16) 7-[3-(5-Mercaptotetrazole-1-yl)benzamido]-10-propargyl-1,2,3,4-tetrahydroacridinium perchlorate
(N-I-17) 6-[3-(5-Mercaptotetrazole-1-yl)benzamido]-1-propargyl-2,3-pentamethylenequinolinium bromide
(N-I-18) 7-(5-Mercaptotetrazole-1-yl)-9-methyl-10-propargyl-1,2,3,4-tetrahydroacridinium bromide
(N-I-19)7-[3-{N-[2-(5-mercapto-1,3,4-thiadiazole-2-yl)thioethyl]carbamoyl}propanamido]-10-propargyl1,2,3,4-tetrahydroacridinium tetrafluoroborate
(N-I-20) 6-(5-Mercaptotetrazole-1-yl)-4-methyl-1-propargyl-2,3-pentamethylenequinolinium bromide
(N-I-21) 7-Ethoxythiocarbonylamino-10-propargyl-1,2-dihydroacridinium trifluoromethanesulfonate
(N-I-22) 7-(5-Mercaprotetrazole-1-yl)-9-methyl-10-propargyl-1,2-dihydroacridinium hexafluorophosphate
(N-I-23) 7-[3-(5-Mercaptotetrazole-1-yl)benzamido]-10-propargyl-1,2-dihydroacridinium bromide $$R^{21}-\underset{\underset{R^{23}}{|}}{N}-\underset{\underset{R^{24}}{|}}{N}-G-R^{22} \qquad \text{(N-II)}$$

In the above formula, $R^{21}$ represents an aliphatic group, an aromatic group, or a heterocyclic group; $R^{22}$ represents hydrogen, an alkyl group, an aralkyl group, an aryl group, an alkoxy group, an aryloxy group, or an amino group; G represents a carbonyl group, a sulfonyl group, a sulfoxy group, a phosphoryl group, or an iminomethylene group (HN=C<); and one of $R^{23}$ and $R^{24}$ represents hydrogen, and the other represents hydrogen, an alkylsulfonyl group, an arylsulfonyl group, or an acyl group. Further, $R^{24}$ may represent a single bond to G. Also, the above-described groups may be substituted, if feasible.

More specifically, $R^{23}$ may have at least one substituent group. Examples of such substituent groups include those named below. Such groups may further be substituted. For instance, an alkyl group, an aralkyl group, an alkoxy group, an alkyl- or aryl-substituted amino group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxyl group, a halogen, a cyano group, a sulfo group and a carboxyl group can be cited. Among these substituent groups, a ureido group is particularly favored.

These groups may be linked to form a ring, if possible.

Preferred groups as $R^{21}$ include aryl groups, aromatic heterocyclic groups and aryl-substituted methyl groups. Among these groups, aryl groups (e.g., phenyl, naphthyl, etc.) are more preferred.

Preferred groups as $R^{22}$ include hydrogen, alkyl groups (e.g., methyl) and aralkyl groups (e.g., o-hydroxybenzyl, etc.), and hydrogen is particularly preferred.

Examples of substituent groups for the groups represented by $R^{22}$, include acyl groups, acyloxy groups, alkyl- and aryl-oxycarbonyl groups, alkenyl groups, alkinyl groups and nitro group in addition to those named above for $R^{21}$.

These substituent groups may further be substituted by one or more thereof. Also, these groups may be connected to one another to form a ring, if possible.

$R^{21}$ or $R^{22}$, especially $R^{21}$, may contain any nondiffusible "ballast" group, which has conventionally been used in couplers, (particularly one connected via a ureido group), or a group capable of accelerating the adsorption to surfaces of silver halide grains represented by $X^2 \leftarrow L^2 \rightarrow_m{}^2$. Herein, $X^2$ has the same meaning as $X^1$ in (N-I), and preferably represents a thioamido group (except for thiosemicarbazido and substituted groups thereof), a mercapto group, or a 5- or 6-membered nitrogen-containing heterocyclic group. $L^2$ represents a linkage divalent group, and has the same meaning as $L^1$ in (N-I). $m^2$ is 0 or 1.

Specific examples of groups preferred as $X^2$ include acyclic thioamido groups (e.g., thioureido, thiourethane), cyclic thioamido groups (i.e., mercapto-substituted nitrogen-containing heterocyclic groups, such as 2-mercapto-1,3,4-thiadiazolyl, 3-mercapto-1,2,4-triazolyl, 5-mercaptotetrazolyl, 2-mercapto-1,3,4-oxadiazolyl, 2-mercaptobenzoxazolyl), and nitrogen-containing heterocyclic groups (e.g., benzotriazolyl, benzimidazolyl, indazolyl).

The groups most preferred as $X^2$ depend on the intended use of the photosensitive material. In color photosensitive materials, for instance, when color forming materials capable of forming dyes by the coupling reaction with oxidation products of p-phenylenediamine type developing agents ("couplers") are utilized, a mercapto-substituted nitrogen-containing heterocyclic group or a nitrogen-containing heterocyclic group capable of forming an iminosilver is preferred as $X^2$. When color forming materials capable of producing diffusible dyes by undergoing cross-oxidation with the oxidation products of developing agents ("DRR compounds") are used, an acyclic thioamido group or a mercapto-substituted nitrogen-containing heterocyclic group is preferred as $X^2$.

In black-and-white photosensitive materials, a mercapto-substituted nitrogen-containing heterocyclic group or a nitrogen-containing heterocyclic group capable of forming an iminosilver is preferred as $X^2$.

As for $R^{23}$ and $R^{24}$, hydrogen is most preferred.

As for G in formula (N-II), a carbonyl group is most preferred.

As for the compounds represented by formula (NII), those containing a group capable of adsorbing to silver halide or a group containing a ureido group are preferred over others.

Compound examples and syntheses methods for the hydrazine type nucleating agents containing a silver halide adsorbing group are described, e.g., in U.S. Pat. Nos. 4,030,925, 4,080,207, 4,031,127, 3,718,470, 4,269,929, 4,276,364, 4,278,748, 4,385,108, 4,459,347, 4,478,928 and 4,560,638, British Patent 2,011,391B, JP-A-54-74729, JP-A-55-163533, JP-A-55-74536 and JP-A-60-179734.

Other hydrazine type nucleating agents are described, e.g., in JP-A-57-86829, U.S. Pat. Nos. 4,560,638, 4,478,928, 2,563,785 and 2,588,982.

Specific examples of the compounds represented by formula (N-II) are cited below. However, the invention is not to be construed as being limited to these examples.

(N-II-1) 1-Formyl-2-{4-[3-(2-methoxyphenyl)ureido]-phenyl hydrazine (N-II-2) 1-Formyl-2-{4-[3-{3-[3-(2,4-di-tert-pentylphenoxy)propyl]ureido}phenylsulfonylamino]-phenyl}hydrazine (N-II-3) 1-Formyl-2-{4-[3-(5-mercaptotetrazole-1-yl)benzamido]phenyl}hydrazine (N-II-4) 1-Formyl-2-[4-{3-[3-(5-mercaptotetrazole-1-yl)phenyl]ureido}phenyl]hydrazine (N-II-5) 1-Formyl-2-[4-{3-[N-(5-mercapto-4-methyl-1,2,4-triazole-3-yl) carbamoyl]propanamido}phenyl]-hydrazine (N-II-6) 1-Formyl-2-{4-[3-{N-[4-(3-mercapto-1,2,4-triazole-4-yl)phenyl]carbamoyl}propanamido]-phenyl}hydrazine (N-II-7) 1-Formyl-2-[4-{3-[N-(5-mercpto-1,3,4-thiadiazole-2-yl)carbamoyl]propanamido}phenyl]hydrazine (N-II-8) 2-[4-(benzotriazole-5-carboxamido)phenyl]-1-formylhydrazine (N-II-9) 2-[4-{3-[N (benzotriazole-5-carboxamido)carbamoyl]propanamido}phenyl]-1-formylhydrazine (N-II-10) 1-Formyl-2-{4-[1-(N-phenylcarbamoyl)thiosemicarbazido]phenyl}hydrazine (N-II-11) 1-Formyl-2-{4-[3 (3-phenylthioureido)benzamido]phenyl}hydrazine (N-II-12) 1-Formyl-2-[4-(3-hexylureido)phenyl]hydrazine (N-II-13) 1-Formyl-2-{4-[3-(5-mercaptotetrazole-1-yl)benzenesulfonamido]phenyl}hydrazine (N-II-14) 1-Formyl-2-{4-[3-{3-{3-(5-mercaptotetrazole-1yl)phenyl}ureido}benzenesulfonamido]phenyl}hydrazine Nucleating agents which are particularly preferably used in the present invention are those containing a group capable of adsorbing to silver halides.

A nucleating agent used in the present invention can be incorporated into a photosensitive material, or added to a processing solution for the photosensitive material. It is preferred to incorporate it into the photosensitive material.

In the photosensitive material, it is desirable that the nucleating agent should be incorporated in an internal latent image type silver halide emulsion layer. However, the nucleating agent can be added to other layers, e.g., an interlayer, a subbing layer or a backing layer, provided that the nucleating agent can diffuse into the emulsion layer during coating or processing and adsorb to silver halide grains. Where a nucleating agent is added to a processing solution, the processing solution may be a developer or a prebath adjusted to a low pH as described in JP-A-58-178350.

When a nucleating agent is used in photosensitive material, a preferred content thereof is from $10^{-8}$ to $10^{-2}$ mole, particularly from $10^{-7}$ to $10^{-3}$ mole, per mole of silver halide.

When added to a processing solution, the nucleating agent is preferably used in an amount of $10^{-5}$ to $10^{-1}$ mole, particularly $10^{-4}$ to $10^{-2}$ mole, per liter of the processing solution.

For the purposes of heightening the maximum image density, lowering the minimum image density, improving the presevability of the photosensitive material, increasing the rate of development, and so on, the following compounds can be added.

Hydroquinones (e.g., compounds described in U.S. Pat. Nos. 3,227,552 and 4,279,987), chromans (e.g., compounds described in U.S. Pat. No. 4,268,621, JP-A-54-103031, and *Research Disclosure* No. 18264, pp. 333–334 (June 1981), quinones (e.g., compounds described in *Research Disclosure,* No. 21206, pp. 433–434 (December 1981)), amines (e.g., compounds described in U.S. Pat. No. 4,150,993 and JP-A-58-174757), oxidizers (e.g., compounds described in JP-A-60-260039 and *Research Disclosure,* No. 1636, pp. 10–11 (May 1978)); catechols (e.g., compounds described in JP-A-55-21013 and JP-A-55-65944), compounds capable of releasing a nucleating agent upon development (e.g., those described in JP-A-60-107029), thioureas (e.g., compounds described in JP-A-60-95533), and spirobisindanes (e.g., compounds described in JP-A-55-65944) can be instanced.

Examples of nucleation accelerators which can be used in the present invention include tetraazaindenes, triaazaindenes and pentaazaindenes, each of which must have at least one mercapto group, optionally substituted with an alkali metal atom or ammonium group, and the compounds described in JP-A-61-136948 (on pages from 2 to 6 and from 16 to 43), and JP-A-63-106656 (on pages 12 to 43). Specific examples of nucleation accelerators are cited below. However, the invention is not to be construed as being limited to these examples.

(A-1) 3-Mercapto-1,2,4-triazolo[4,5-a]pyridine (A-2) 3-Mercapto-1,2,4-triazolo[4,5-a]pyrimidine (A-3) 5-Mercapto-1,2,4-triazolo[1,5-a]pyrimidine (A-4) 7-(2-Dimethylaminoethyl)-5-mercapto-1,2,4-triazolo[1,5-a]pyrimidine (A-5) 3-Mercapto-7-methyl-1,2,4-triazolo[4,5-a]pyrimidine (A-6) 3,6-Dimercapto-1,2,4-triazolo[4,5-b]pyridazine (A-7) 2-Mercapto-5-methylthio-1,3,4-thiadiazole (A-8) 3-Mercapto-4-methyl-1,2,4-triazole (A-9) 2-(3-Dimethylaminopropylthio)-5-mercapto-1,3,4-thiadiazole hydrochloride (A-10) 2-(2-Morpholinoethylthio)-5-mercapto-1,3,4-thiadiazole hydrochloride (A-11) Sodium salt of 2-Mercapto-5-methylthiomethylthio1,3,4-thiadiazole (A-12) 4-(2-morpholinoethyl)-3-mercapto-1,2,4-triazole (A-13) 2-[2-(2-Dimethylaminoethylthio)ethylthio]-5-mercapto-1,3,4-thiadiazole hydrochloride (A-14) 2-(6-Dimethylaminohexylthio)-5-mercapto-1,3,4-thiadiazole hydrochloride (A-15) 2-{3-[2-methyl-1-(1,4,5,6-tetrahydropyrimidinyl)]propylthio}-5-mercapto-1,3,4-thiadiazole hydrochloride It is desirable that such a nucleation accelerator as described above is incorporated into silver halide emulsion layers or the layers adjacent thereto.

In this case, a preferred amount of the nucleation accelerator added is from $10^{-6}$ to $10^{-2}$ mole, particularly $10^{-5}$ to $10^{-2}$ mole, per mole of silver halide.

When added to a processing solution, that is, a developer or a prebath thereof, the nucleation accelerator is preferably used in an amount of $10^{-8}$ to $10^{-3}$ mole, particularly $10^{-7}$ to $10^{-4}$ mole, per liter of the processing solution.

Also, two or more nucleation accelerators may be used in combination.

A color developer which can be used for the development processing of the photosensitive material to be used in the present invention is preferably an alkaline aqueous solution containing as a main component an aromatic primary amine color developing agent. Though aminophenol compounds are also useful as a color developing agent, p-phenylenediamine compounds are preferred herein. Representative examples of p-phenylenediamine compounds include 3-methyl-4-amino-N,N-diethylaniline, 3-methyl-4-amino-N-ethyl-N-β-hydroxyaniline, 3-methyl-4-amino-N-ethyl-β-methanesulfonamidoethylaniline, 3-methyl-4-amino-N-ethyl-N-β-methoxyethylaniline, and the sulfates, hydrochlorides or p-toluenesulfonates of these anilines. These compounds can be used as a mixture of two or more thereof depending on the intended use.

In addition, the color developer generally contains pH buffering agents such as carbonates, borates or phosphates of alkali metals, and development inhibitors or antifoggants, such as bromides, iodides, benzimidazoles, benzothiazoles or mercapto compounds. Further, it can optionally contain various preservatives, such as hydroxylamine, diethylhy-droxylamine, sulfites, hydrazines, phenylsemicarbazides, triethanolamine, catechol sulfonic acids, and triethylenediamine(1,4-diazabicyclo[2,2,2]octane)'s; organic solvents, such as ethylene glycol, and diethylene glycol; development accelerators, such as benzyl alcohol, polyethylene glycol, quaternary ammonium salts, and amines; dye-forming couplers; competing couplers; fogging agents such as sodium borohydride; auxiliary developing agents such as 1-phenyl-3-pyrazolidone; viscosity imparting agents; chelating agents as represented by aminopolycarboxylic acids, aminopolyphosphonic acids, alkylphosphonic acids, and phosphonocarboxylic acids, with specific examples including ethylenediaminetetraacetic acid, nitrilotriacetic acid, diethylenetriaminepentaacetic acid, cyclohexanediaminetetraacetic acid, hydroxyethyliminodi-acetic acid, 1-hydroxyethylidene-1,1-diphosphonic acid, nitrilo-N,N,N-trimethylenephosphonic acid, ethylenedi-amine-N,N,N',N'-tetramethylenephosphonic acid, ethylenedi-aminedi(o-hydroxyphenylacetic acid), and salts thereof.

In general, the pH of such a color developer as described above ranges from about 9 to about 12.

An amount of a replenisher to be added to the foregoing developer, though depending on a chosen color photographic material, is generally at most about 1 liter per square meter of the photographic material. When a replenisher having a reduced bromide ion concentration is used, the replenishing amount can be even reduced to less than about 300 ml. In using a reduced amount of replenisher, it is desired that evaporation and aerial oxidation of the developer are prevented by diminishing the contact area of the processing tank with the atmosphere. Also, a reduction in the amount of the replenisher to be added can be achieved by suppressing the accummulation of bromide ion in the developer.

After color development, the photographic emulsion layer is generally subjected to a bleach processing. The bleach processing may be carried out simultaneously with a fixation processing (a bleach-fix processing), or separately therefrom. For the purpose of rapid photographic processing, the bleach processing may be succeeded by the bleach-fix processing. Also, the processing may be performed with two successive bleach-fix baths, or the fixation processing may be succeeded by the bleach-fix processing, or the bleach-fix processing may be succeeded by the bleach processing, if desired. Examples of bleaching agents which can be used include compounds of polyvalent metals, such as Fe(III), Co(III), Cr(VI), Cu(II); peroxy acids; quinones; and nitro compounds. More specifically, ferricyanides; dichromates; organic complex carboxylic acids, such as ethylenediaminetetraacetic acid, diethylenetriaminepenta-acetic acid, cyclohexanediaminetetraacetic acid, methyliminodiacetic acid, 1,3-diaminopropanetetraacetic acid, glycol ether diamine tetraacetic acid, citric acid, tartaric acid, malic acid; persulfates; hydrobromides; permanganates; and nitrobenzenes are representative bleaching agents. Of these bleaching agents, aminopolycarboxylic acid Fe(III) complex salts including ethylenediaminetetraacetato iron(III) complex, and persulfates are preferred in respect of rapid processing and prevention of environmental pollution. In particular, aminopolycarboxylic acid Fe(III) complex salts are useful in both bleaching baths and bleach-fix baths. The pH of the bleaching or bleach-fix bath which uses an aminopolycarboxylic acid Fe(III) complex salt as a bleaching agent generally ranges from about 5.5 to about 8, but the processing can be performed under a lower pH for the purpose of increasing the processing speed.

In the bleaching bath, the bleach-fix bath and prebaths thereof, bleach accelerators can be used, if needed. Specific examples of useful bleach accelerators include compounds having a mercapto group or a disulfide linkage as described in U.S. Pat. No. 3,893,858, West German Patent 1,290,812, JP-A-53-95630, *Research Disclosure* No. 17129 (Jul. 1978); thiazolidine derivatives as described in JP-A-50-140129; thiourea derivatives as described in U.S. Pat. No. 3,706,561; iodides as described in JP-A-58-16235; polyoxyethylene compounds as described in West German Patent 2,748,430; polyamine compounds as described in JP-B-45-8836; and bromide ions. Of these bleach accelerators, compounds having a mercapto group or a disulfide linkage are preferred because of their great effect upon bleach acceleration. In particular, the compounds described in U.S. Pat. No. 3,893,858, West German Patent 1,290,812 and JP A-53-95630 are effective. In addition, compounds described in U.S. Pat. No. 4,552,834 are preferred. These bleach accelerators may be incorporated in the photosensitive material. When a color photosensitive material for photographing is subjected to a bleach-fix processing, these bleach accelerators can have a particularly great effect.

Examples of fixing agents which can be used include thiosulfates, thiocyanates, thioether compounds, thioureas and a large amount of iodide. Of these, generally used fixing agents are thiosulfates, especially ammonium thiosulfate. As for preservatives for a bleach-fix bath, sulfites, bisulfites or adducts of carbonyl compounds and bisulfite are preferably used.

After a desilvering step, the silver halide photographic material of the present invention is, in general, subjected to a washing step and/or a stabilizing step. The volume of washing water required in the washing step can be determined variously depending on the characteristics of photosensitive materials processed (depending, e.g., on what kinds of couplers are incorporated therein), the end-use of photosensitive materials processed, the temperature of washing water, the number of washing tanks (stage number), the replenishing method for washing water (e.g., whether the current of water flows in the counter direction, or not), and other various conditions. Of these conditions, the relation between the number of washing tanks and the volume of washing water in the multistage counter current process can be determined according to the methods described in *Journal of the Society of Motion Picture and Television Engineers,* vol. 64, pages 248–253 (May 1955).

According to the multistage counter current process described in the above-cited article, the volume of washing water can be sharply decreased. However, the process has disadvantages, e.g., in that bacteria propagate in the tanks because of an increase in standing time of water in the tanks, and suspended matter produced from the bacteria sticks to photosensitive materials processed therein. For solving such problems caused in the processing of the color photosensitive material of the present invention, when the above-described process is applied, the method of reducing the contents of calcium ion and magnesium ion, which is described in JP-A-62-288838, can be employed to great advantage. Further, bactericides such as iso-thiazolone compounds and thiabendazoles described in JP-A-57-8542, chlorine-containing germicides such as sodium salts of chlorinated isocyanuric acid and benzotriazoles, as described in Hiroshi Horiguchi *Bohkin- Bobai-Zai no Kagaku* ("Chemistry of Antibacteria and Antimolds"), *Biseibutsu no Mekkin Sakkin Bohbai Gijutsu* ("Arts of Sterilizing and Pasteurizing Microbe, and Mold-Proofing"), compiled by Eisei Gijutsu Kai, and *Bohkin- Bohbai-Zai Jiten* (which means "Thesaurus of Antibacteria and Antimolds"), compiled by Nippon Bohkin Bohbi Gakkai.

The washing water used in the processing of the photosensitive material of the present invention is adjusted to a pH of about 4–9, preferably to a pH of 5–8. The washing temperature and washing time can be chosen variously depending on the characteristics and the intended use of the photosensitive material to be washed, and are generally from about 20 sec. to about 10 min. at about 15°–45° C., or 30 sec. to 5 min. at 25°–40° C.

Also, the photosensitive material of the present invention can be processed directly with a stabilizing solution in place of using the above-described washing water, by conventional methods described in JP-A-57-8543, JP-A-58-14834 and JP-A-60-220345.

To the stabilizing bath various chelating agents and antimolds can be added. Washing water and/or the stabilizing solution overflowing the processing baths with replenishment can also be reused in other steps such as the desilvering step.

For the purpose of simplification and rapidity of the photographic processing method of the present invention, a color developing agent may be incorporated in the silver halide photosensitive material, and it is desirable that the color developing agent should be used in the form of precursors of various types. For instance, indoaniline compounds described in U.S. Pat. No. 3,342,597, Schiff base compounds described in U.S. Pat. No. 3,342,599 and *Research Disclosure,* Nos. 14850 (August 1976) and 15159 (November 1976), aldol compounds described id., No. 13924 (November 1975), metal complex salts described in U.S. Pat. No. 3,719,492, and urethane compounds described in JP-A-53-135628 can be used.

In the silver halide photosensitive material used in the present invention, various 1-phenyl-3-pyrazolidones may be incorporated for the purpose of accelerating color development. Typical examples of such compounds are described in JP-A-56-64339, JP-A-57-144547 and JP-A-58-115438.

The temperature of each processing bath used in the present invention ranges from about 10° C. to about 50° C. Though a standard temperature is within the range of about 33° to about 38° C., temperatures higher than this can be adopted for reduction of processing time through acceleration of the processing, while those lower than this enable the achievement of improved image quality and enhanced stability of the processing bath. Further, processing utilizing a cobalt or hydrogen peroxide intensification method as described in West German Patent 2, 226,770 or U.S. Pat. No. 3,674,499 may be carried out for the purpose of saving silver.

It is desirable that a replenisher in each processing step should be used in a small amount rather than in a large one. A preferred replenishing amount is 0.1 to 50 times, particularly 3 to 30 times, the amount of the processing solution brought from the prebath per unit area of the photosensitive material to be processed.

For development of a black-and-white photosensitive material in the present invention, various conventional developing agents can be employed. Specifically, polyhydroxybenzenes, such as hydroquinone, 2-chlorohydroquinone, 2-methylhydroquinone, catechol, pyrogallol; aminophenols, such as p-aminophenol, N-methyl-p-aminophenol, 2,4-diaminophenol; 3-pyrazolidones, such as 1-phenyl-3-pyrazolidone, 1-phenyl-4,4'-dimethyl-3-pyrazolidone, 1-phenyl-4-methyl-4-hydroxymethyl-3-pyrazolidone, 5,5-dimethyl-1-phenyl-3-pyrazolidone; and ascorbic acid can be used independently or in a combination of two or more thereof. Also, developers described in JP-A-58-55928 can be employed. Such developers may be contained in an alkaline processing composition (a processing element), or incorporated in an appropriate constituent layer of a photosensitive element.

The developer may contain, as a preservative, sodium sulfite, potassium sulfite, ascorbic acid, or reductones (e.g., piperidinohexose reductone).

When DRR compounds are used in the present invention, any silver halide developing agent or any electron donating agent can be used in the developer, provided that it can undergo a cross oxidation reaction with the DRR compounds. Such developers may be added to an alkaline developing composition (a processing element), or incorporated in an appropriate layer of a photographic element. Specific examples of such developers include hydroquinone, aminophenols such as N-methylaminophenol, 1-phenyl-3-pyrazolidinone, 1-phenyl-4,4-dimethyl-3-pyrazolidinone, 1-phenyl-4methyl-4-oxymethyl-3-pyrazolidinone, N,N-diethyl-p-phenylenediamine, 3-methyl-N,N-diethyl-p-phenylenediamine and 3-methoxy-N-ethoxy-p-phenylenediamine.

Of these developing agents, in analogy with the case of the foregoing alkaline processing composition, black-and-white developing agents capable of reducing stain formation in the image-receiving layer (a mordanting layer) are particularly preferred.

When the photosensitive material of the present invention is applied to film unit for the diffusion transfer process, it is desirable that the material should be processed with a viscous developer. This viscous developer is a liquid composition containing ingredients necessary for the development of a silver halide emulsion (and for the formation of dye images through diffusion transfer). A main component of the solvent thereof is water, and a hydrophilic solvent such as methanol, methyl cellosolve or the like may optionally be used together. The processing composition preferably contains a hydrophilic polymer of high molecular weight, such as polyvinyl alcohol, hydroxyethyl cellolose, sodium carboxymethylcellulose or the like. It is desirable that such a polymer should be added to the processing composition in such an amount as to impart a viscosity of about 1 poise or above, preferably from about 500 to about 1,000 poise, at room temperature.

The above-described processing composition is preferably charged in a pressure-rupturable container described in U.S. Pat. Nos. 2,543,181, 2,643,886, 2,653,732, 2,723,051, 3,056,491, 3,056,492 and 3,512,515.

The invention is now described in greater detail with reference to the following specific examples and embodiments thereof, but the present invention is not to be construed as being limited thereto. Unless otherwise indicated, all parts, percents and ratios are by weight.

EXAMPLE 1

Preparation of Emulsion A-1:

To 1 liter of a 3.0 wt % gelatin solution containing 0.06 mole of potassium bromide, a 0.7 mol/l silver nitrate solution and a 0.7 mol/l potassium bromide solution were added in the same amount of 30 ml each in a period of 15 seconds at 30° C. by a double jet process while the gelatin solution was agitated. Then, the reaction mixture was heated to 75° C., and thereto was added 400 ml of a 10 wt % gelatin solution.

After the solution of the foregoing first-stage addition, 80 ml of a 0.6 mol/l silver nitrate solution was added dropwise over a 30-minute period.

Thereafter, 200 ml of a 1.47 mol/l silver nitrate solution and 200 ml of a 1.47 mol/l potassium bromide solution were added by a double jet process at a flow rate which was increased such that the flow rate at the conclusion of addition was 19 times that at the beginning of addition. Therein, the pBr was kept at 2.8. The thus prepared emulsion was washed by a conventional flocculation method, and thereto was added 32 g of a dispersant gelatin to prepare 400 g of a core emulsion. The thus-obtained silver halide grains contained the hexagonal tabular silver halide grains according to the invention in an amount of 74 wt % based on the total silver amount of the thus-obtained silver halide grains, and the variation coefficient of these grains was 15%. The diameter of these grains, which corresponds to an average diameter of circles having the same projected areas as these grains, was 0.4 μm, and their average thickness was 0.08 μm.

To a 200 g portion of the foregoing core emulsion, 800 ml of water and 30 g of gelatin were added, and dissolved. Then, it was heated to 75° C., and thereto were added 30 mg of 3,4-dimethyl-1,3-thiazoline-2-thione, and subsequently 3 mg of sodium thiosulfate and 1 mg of potassium chloroaurate. The resulting emulsion was heated at 70° C. over a period of 70 minutes to effect chemical sensitization. To the thus-chemically-sensitized core emulsion, in a similar manner as for preparation of the core emulsion, 520 ml of a 1.47 mol/l silver nitrate solution and 520 ml of a 1.47 mol/l potassium bromide solution were added at a flow rate which was increased so that the flow rate at the conclusion of addition was 5 times that at the beginning of addition, by a double jet method, as the pBr at 70° C. was maintained at 2.8. The thus-prepared emulsion was washed by a conventional flocculation method, and thereto was added 50 g of dispersant gelatin to obtain 1,500 g of a core/shell emulsion. The diameter of the tabular grains obtained, which corresponds to an average diameter of circles having the same projected areas as these grains, was 0.8 μm, and their average thickness was 0.13 μm. The thus-obtained tabular grains contained the hexagonal tabular grains according to the invention in an amount of 72 wt % based on the total silver amount of the thus-obtained tabular grains, and the variation coefficient of these grains was 14%.

To this core/shell emulsion, 1.5 mg of sodium thiosulfate, 10 mg of poly(N-vinylpyrrolidone) (molecular weight: 20,000) and 1.2 mg of chloroauric acid (tetrahydrate) were added, and heated at 60° C. for 40 minutes. Thus, the surfaces of the individual grains were chemically sensitized. (Emulsion A-1)

Preparation of Emulsion C-1:

To an aqueous gelatin solution containing 3,4-dimethyl-1,3-thiazoline-2-thione in an amount of 0.3 per mole of Ag, an aqueous solution of potassium bromide and that of silver nitrate were added at the same time at 75° C. over a period of about 20 minutes with vigorous stirring. Thus, a monodisperse octahedral silver bromide emulsion having an average grain size of 0.40 μm was obtained. This emulsion was chemically sensitized by adding thereto 6 mg/mol Ag of sodium thiosulfate and 7 mg/mol Ag of chloroauric acid (tetrahydrate), and heating it at 75° C. for 80 minutes. The thus prepared silver bromide grains were used as core grains, and silver bromide was further grown thereon under the same precipitation conditions as in the first stage to finally obtain a monodisperse core/shell type octahedral silver bromide emulsion having an average grain diameter of about 0.7 μm. The variation coefficient in the size distribution of the thus obtained grains was 10%.

To this emulsion, sodium thiosulfate and chloroauric acid (tetrahydrate) were added in the same amount of 1.5 mg per 1 mole of silver, and heated at 60° C. over a period of 60 minutes to effect chemical sensitization. Thus, the internal latent image type silver halide emulsion C-1 was obtained.

A multilayer color photosensitive material having the layer structure shown in the following Table 1 on a paper support laminated with a polyethylene layer on both sides thereof was prepared using emulsion A-1. Similarly, a photosensitive material for comparison was prepared using emulsion C-1.

TABLE 1

| | |
|---|---|
| E9 Layer | Protective layer |

TABLE 1-continued

| | |
|---|---|
| E8 Layer | Ultraviolet absorbing layer |
| E7 Layer | Blue-sensitive emulsion layer |
| E6 Layer | Interlayer |
| E5 Layer | Yellow filter layer |
| E4 Layer | Interlayer |
| E3 Layer | Green-sensitive emulsion layer |
| E2 Layer | Interlayer |
| E1 Layer | Red-sensitive emulsion layer |
| | Support |
| B1 Layer | Backing layer |
| B2 Layer | Protective layer |

The compositions of these layers are described below. The numbers therein indicate the coverages expressed in g/m$^2$. However, the coverages of silver halide emulsions and colloidal silvers are those based on silver, and of spectral sensitizing dyes are addition amounts expressed in mole per mole of silver halide.

Support

Polyethylene-laminated paper (105 μm thick). The polyethylene laminate on the E1 layer side contained 4 g/m$^2$ of a white pigment ($TiO_2$) (particle size: 0.25 μm) and 1 g/m$^2$ of a bluish dye (ultramarine).

| | |
|---|---|
| E1 Layer | |
| Silver halide emulsion (Emulsion A-1) | 0.26 |
| Spectral sensitizing dye (ExSS-1) | $1.0 \times 10^{-4}$ |
| Spectral sensitizing dye (ExSS-2) | $6.1 \times 10^{-5}$ |
| Gelatin | 1.11 |
| Cyan coupler (ExCC-1) | 0.21 |
| Cyan coupler (ExCC-2) | 0.26 |
| Ultraviolet absorbent (ExUV-1) | 0.17 |
| Solvent (ExS-1) | 0.23 |
| Development modifier (ExGC-1) | 0.02 |
| Stabilizer (ExA-1) | 0.006 |
| Nucleation accelerator (ExSZ-1) | $3.0 \times 10^{-4}$ |
| Nucleating agent (ExZK-1) | $8.0 \times 10^{-6}$ |
| E2 Layer | |
| Gelatin | 1.41 |
| Color stain inhibitor (ExKB-1) | 0.09 |
| Solvent (ExS-1) | 0.10 |
| Solvent (ExS-2) | 0.10 |
| E3 Layer | |
| Silver halide emulsion (Emulsion A-1) | 0.23 |
| Spectral sensitizing dye (ExSS-3) | $3.0 \times 10^{-4}$ |
| Gelatin | 1.05 |
| Magenta coupler (ExMC-1) | 0.16 |
| Color image stabilizer (ExSA-1) | 0.20 |
| Solvent (ExS-3) | 0.25 |

-continued

| | |
|---|---|
| Development modifier (ExGC-1) | 0.02 |
| Stabilizer (ExA-1) | 0.006 |
| Nucleation accelerator (ExZS-1) | $2.7 \times 10^{-4}$ |
| Nucleating agent (ExZK-1) | $1.4 \times 10^{-5}$ |
| E4 Layer | |
| Gelatin | 0.47 |
| Color stain inhibitor (ExKB-1) | 0.03 |
| Irradiation inhibiting dye (ExIS-1) | 0.012 |
| Irradiation inhibiting dye (ExIS-2) | 0.018 |
| Solvent (ExS-1) | 0.03 |
| Solvent (ExS-2) | 0.03 |
| E5 Layer | |
| Colloidal silver (particle size: 100Å) | 0.09 |
| Gelatin | 0.49 |
| Color stain inhibitor (ExKB-1) | 0.03 |
| Solvent (ExS-1) | 0.03 |
| Solvent (ExS-2) | 0.03 |
| E6 Layer | |
| The same as E4 layer. | |
| E7 Layer | |
| Silver halide emulsion (Emulsion A-1) | 0.40 |
| Spectral sensitizing dye (ExSS-4) | $4.2 \times 10^{-4}$ |
| Gelatin | 2.17 |
| Yellow coupler (ExYC-1) | 0.51 |
| Solvent (ExS-2) | 0.20 |
| Solvent (ExS-4) | 0.20 |
| Development modifier (ExGC-1) | 0.06 |
| Stabilizer (ExA-1) | 0.001 |
| Nucleation accelerator (ExZS-1) | $5.0 \times 10^{-4}$ |
| Nucleating agent (ExZK-1) | $1.2 \times 10^{-6}$ |
| E8 Layer | |
| Gelatin | 0.54 |
| Ultraviolet absorbent (ExUV-2) | 0.21 |
| Solvent (ExS-4) | 0.08 |
| E9 Layer | |
| Gelatin | 1.28 |
| Acryl denatured copolymer of polyvinyl alcohol (denaturation degree: 17%, molecular weight: 50,000) | 0.17 |
| Liquid paraffin | 0.03 |
| Latex particles of polymethylmethacrylate (average particle size: 2.8 micron) | 0.05 |
| B1 Layer | |
| Gelatin | 8.70 |
| B2 Layer | |
| The same as E9 layer | |

To each of the foregoing layers, a gelatin hardener ExGK-1 and a surface active agent were further added.

The compounds used for preparing the samples are illustrated below.

Cyan Coupler ExCC-1)

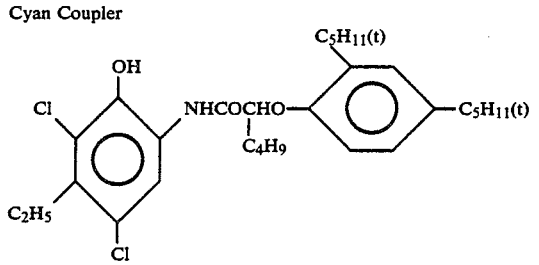

Cyan coupler (ExCC-2)

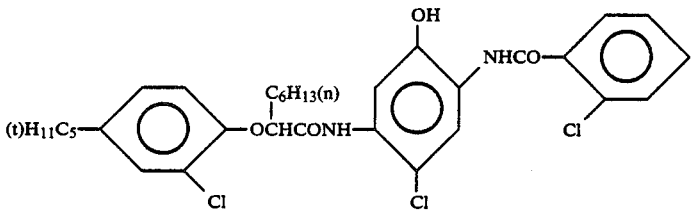

-continued
Magenta coupler (ExMC-1)
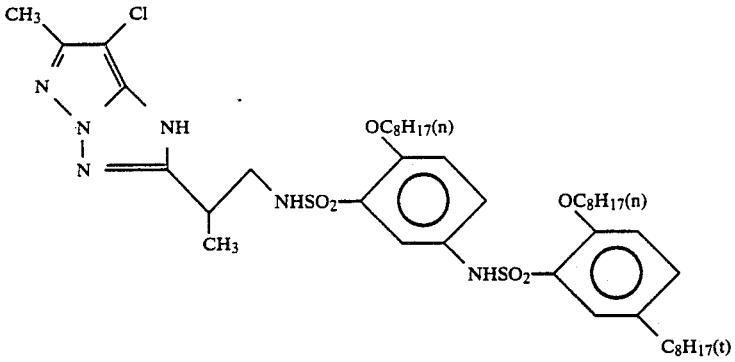
Yellow coupler (ExYC-1)
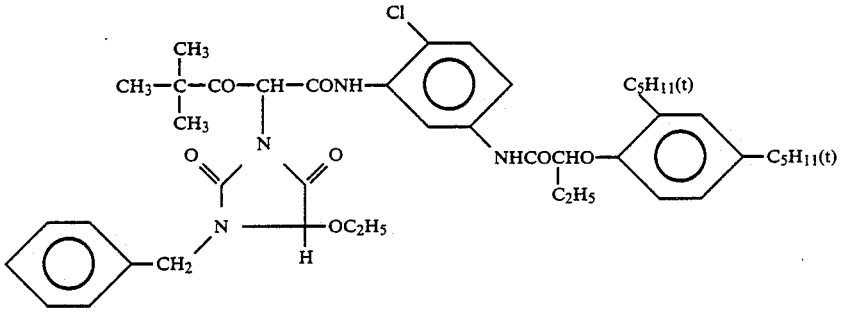
Spectral Sensitizing Dye (ExSS-1)
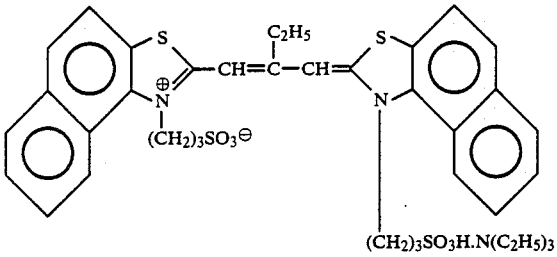
Spectral Sensitizing Dye (ExSS-2)
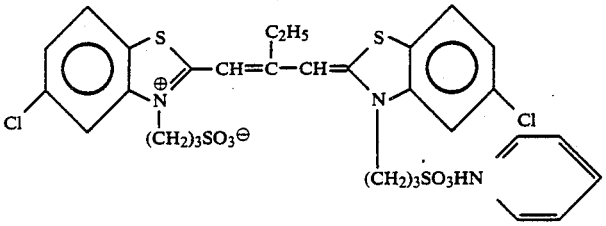
Spectral Sensitizing Dye (ExSS-3)
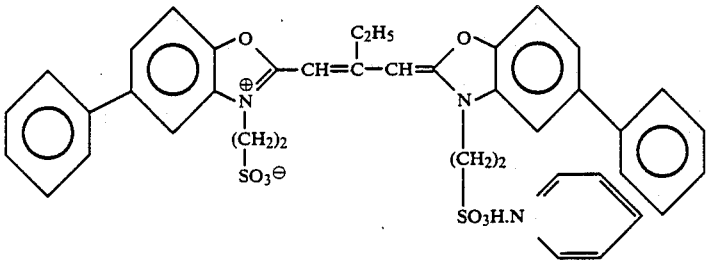
Spectral Sensitizing Dye (ExSS-4)

-continued
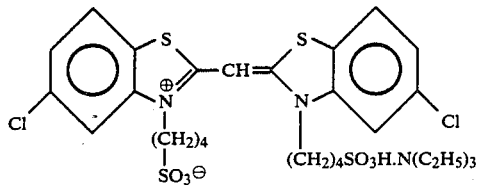
Solvent (ExS-1)
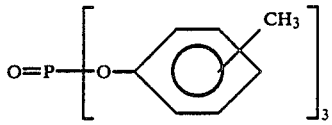
Solvent (ExS-2)
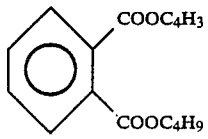
Solvent (ExS-3)
1:1 (by volume) mixture of $O{=}P{-}\left(OCH_2CH(C_2H_5)C_4H_9\right)_3$ and
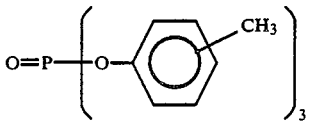
Solvent (ExS-4)
$O{=}P{-}(O{-}C_9H_{19}(iso))_3$
Irradiation Inhibiting Dye (ExIS-1)
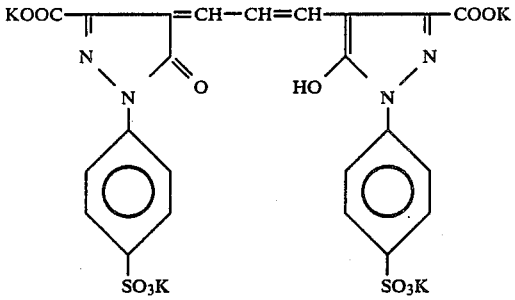
Irradiation Inhibiting Dye (ExIS-2)
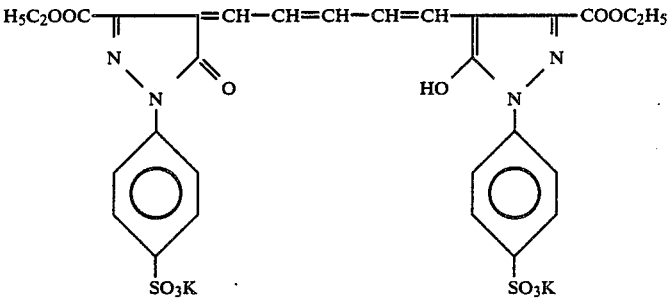
Ultraviolet Absorbent (ExUV-1)
5:8:9 (by weight) mixture of (1), (2) and (3)

-continued (1)

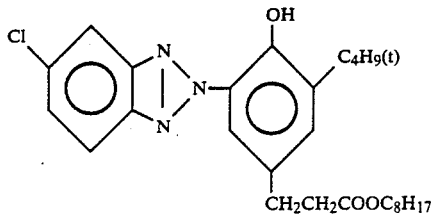

(2)

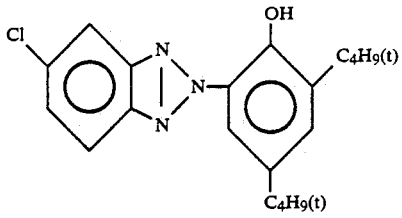

(3)

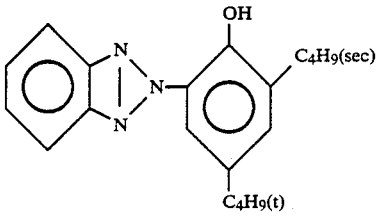

(ExUV-2) Ultraviolet Absorbent

2:9:8 (by weight) mixture of the foregoing (1), (2) and (3).

Color Image Stabilizer (ExSA-1)

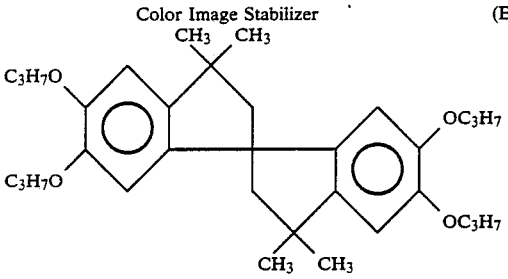

Color Stain Inhibitor (ExKB-1)

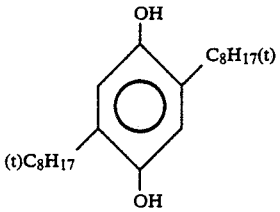

Development Modifier (ExGC-1)

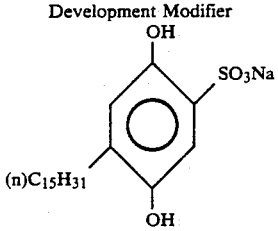

(ExA-1) Stabilizer

4-Hydroxy-5,6-trimethylene-1,3,3a,7-tetraazaindene.

(ExZS-1) Nucleation Accelerator 2-(3-Dimethylaminopropylthio)-5-mercapto-1,3,4-thiadiazole hydrochloride.

(ExZK-1) Nucleating Agent

7-[3-(5-Mercaptotetrazole-1-yl)benzamido]-10-propargyl-1,2,3,4-tetrahydroacridinium perchlorate.

(ExGK-1) Gelatin Hardener

Sodium salt of 1-oxy-3,5-dichloro-s-triazine.

The thus prepared color photographic paper was subjected to wedgewise exposure (1/10 sec., 10 CMS), and then to the photographic processing A including the steps described below. The color density of the thus developed magenta image was measured, and the graininess thereof was observed by means of an optical microscope (×80). The results of graininess were evaluated according to the following criterion:

Good: practically usable

Bad: not usable

The results obtained are shown in Table 2.

| Photographic Processing A | | | |
|---|---|---|---|
| Step | Time | Temperature | Amount replenished |
| Color Development | 90 sec. | 38° C. | 290 ml/m$^2$ |
| Bleach-Fix | 45 sec. | 35° C. | 290 ml/m$^2$ |
| Washing (1) | 30 sec. | 35° C. | — |
| Washing (2) | 30 sec. | 35° C. | — |
| Washing (3) | 30 sec. | 35° C. | 320 ml/m$^2$ |

The replenishment of washing water was performed by a countercurrent replenishing process, wherein the washing bath (3) was replenished with washing solution, and the solution overflowing from washing bath (3) was introduced into washing bath (2), and the solution overflowing from washing bath (2) was introduced into washing bath (1). Therein, the amount of the processing solution carried over by the photosensitive material from the prebath into the washing bath (1) was 35 ml/m$^2$. Accordingly, the replenishing factor was 9.1.

The compositions of the processing solutions used were as follows.

| Color Developer | Solution | Replenisher |
|---|---|---|
| Diethylenetriamine pentaacetic acid | 0.5 g | 0.5 g |
| 1-Hydroxyethylidene-1,1-diphosphonic acid | 0.5 g | 0.5 g |
| Diethylene glycol | 8.0 g | 13.0 g |
| Benzyl alcohol | 12.0 g | 18.5 g |
| Sodium bromide | 0.7 g | — |
| Sodium chloride | 0.5 g | — |
| Sodium sulfite | 2.0 g | 2.5 g |
| N,N-diethylhydroxylamine | 3.5 g | 4.5 g |
| Triethylenediamine(1,4-diazabicyclo[2,2,2]octane) | 3.5 g | 4.5 g |
| 3-Methyl-4-amino-N-ethyl-N-(β-methanesulfonamidoethyl)aniline | 5.5 g | 8.0 g |
| Potassium carbonate | 30.0 g | 30.0 g |
| Brightening agent (stilbene type) | 1.0 g | 1.3 g |
| Purified water to make | 1,000 ml | 1,000 ml |
| pH | 10.50 | 10.90 |

The pH adjustment was carried out using potassium hydroxide or hydrochloric acid.

| Bleach-fix Bath | Solution = Replenisher |
|---|---|
| Ammonium thiosulfate | 100 g |
| Sodium hydrogen sulfite | 21.0 g |
| Ammonium ethylenediaminetetraacetatoferrate(III) dihydrate | 50.0 g |
| Disodium ethylenediaminetetraacetate dihydrate | 5.0 g |
| Purified water to make | 1,000 ml |
| pH | 6.3 |

The pH adjustment was carried out using aqueous ammonia or hydrochloric acid.

Washing Water

Purified water was used as both solution and replenisher. The term "purified water" as used herein refers to water obtained by performing an ion exchange treatment for removing all cations other than $H^{\oplus}$ and all anions other than $OH^{\ominus}$ from city water, until every ion concentration was reduced to 1 ppm or less.

TABLE 2

| Sample No. | Emulsion | Dmax | Dmin | Sensitivity | Graininess | Gradation* |
|---|---|---|---|---|---|---|
| 1 | A-1 | 2.52 | 0.12 | 100 | Good | 3.1 |
| 2 | C-1 | 2.38 | 0.12 | 90 | Bad | 1.9 |

*Average gradation determined from the density region extending over 0.3 and 1.0.

Sample No. 1 using the emulsion A-1 prepared in accordance with the present invention was superior because of its superiority in graininess to sample No. 2 for comparison.

Similar results were obtained with respect to yellow density and cyan density. In addition, the rereversal negative sensitivity was lower in the sample No. than in the sample No. 2.

EXAMPLE 2

Another color photographic paper was prepared in the same manner as in Example 1, except the magenta coupler contained in the E3 layer was replaced by a magenta coupler having the following structural formula:

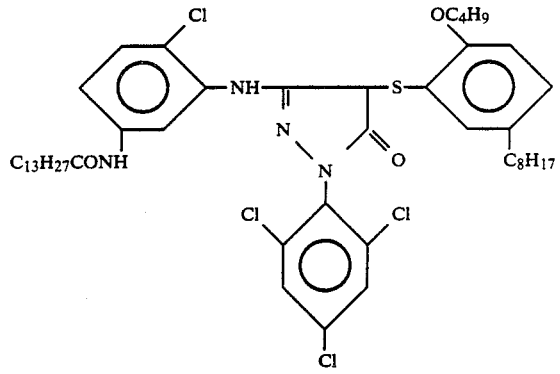

After this photographic paper was exposed in the same manner as in Example 1, photographic processing was performed with an automatic developing machine which was equipped with an 8-liter color developer tank, a 3-liter bleach-fix bath tank and three separate washing tanks having a volume of 3 liter each, which were filled with their respective processing baths having the same composition as used in Example 1. Processing was continued until the total processed area of the photographic paper reached 60 $m^2$. Thereafter, the photographic processing was further performed using the resulting exhausted processing baths (the pH of the exhausted color developer was 10.40). Two different color development times, 70 sec. and 90 sec., were used (the development time in the photographic processing A employed in Example 1 was 90 sec.). Color densities of the thus-developed magenta images were measured, and the results are shown in Table 3.

TABLE 3

| | | Color Development Time | | | |
|---|---|---|---|---|---|
| | | 70 sec. | | 90 sec. | |
| Sample No. | Emulsion | Dmax | Dmin | Dmax | Dmin |
| 21 | A-1 | 2.42 | 0.11 | 2.46 | 0.12 |
| 22 | C-1 | 2.01 | 0.11 | 2.35 | 0.12 |

Sample No. 21 prepared in accordance with the present invention was superior because of its high maximum density in both cases. In particular, the Dmax difference between two samples was remarkable in the case of the short development time.

EXAMPLE 3

Another core/shell emulsion C-2 was prepared in the same manner as the emulsion A-1, except the pBr at the time of core growth was changed to 2.4 and the pBr at the time of shell growth was changed to 1.6.

The thus-obtained tabular grains contained the hexagonal tabular grains according to the invention in an amount of 69 wt % based on the total silver amount of the thus-obtained tabular grains, and the variation coefficient of these grains was 14%. The diameter of these grains, which was the average diameter of circles having the same projected areas as these grains, was 0.1 μm, and their average thickness was 0.09 μm.

A color photographic paper was produced in the same manner as in Example 2, except emulsion C-2 was used in place of emulsion A-1, and it was subjected to the same exposure and subsequent photographic processing as in Example 2, except that the color development time was changed to 120 sec.

The color densities of the thus-developed yellow images were measured, and the results are shown in table

TABLE 4

| Sample No. | Emulsion | Dmax | Dmin |
|---|---|---|---|
| 1 | A-1 | 2.41 | 0.12 |
| 32 | C-2 | 2.40 | 0.15 |

The sample No. 1 according to the present invention had lower Dmin, and thus was superior to sample No. 32 produced for comparison.

EXAMPLE 4

Preparation of Emulsion A-2:

To 1 liter of a 3.0 wt % gelatin solution containing 0.07 mole of potassium bromide, a 0.7 mol/l silver nitrate solution and a 0.7 mol/l potassium bromide solution were added in the same amount of 15 ml in a period of 15 seconds at 30° C. by a double jet process while the gelatin solution was agitated. Then, the reaction mixture was heated to 75° C., and thereto was added 400 ml of a 10 wt % gelatin solution.

After the conclusion of the foregoing first-stage addition, 80 ml of a 0.6 mol/l silver nitrate solution was added dropwise over a 30-minute period.

Thereafter, 600 ml of a 1.47 mol/l silver nitrate solution and 600 ml of a 1.47 mol/l potassium bromide solution were added by a double jet process at a flow rate which was increased so that the flow rate at the conclusion of addition was 19 times that at the beginning of addition. Therein, the pBr was kept at 2.4. The thus-prepared emulsion was washed by a conventional flocculation method, and thereto was added 30 g of a dispersant gelatin to prepare 1,200 g of a core emulsion. The thus-obtained silver halide grains contained the hexagonal tabular silver halide grains according to the invention in an amount of 76 wt % based on the total silver amount of the thus-obtained silver halide grains, and the variation coefficient of these grains was 15%. The diameter of these grains, which was the average diameter of circles having the same projected areas as these grains, was 1.3 μm, and their average thickness was 0.14 μm.

To a 200 g portion of the foregoing core emulsion, 800 ml of water and 30 g of gelatin were added, and dissolved, and it was heated to 75° C., and thereto were added 30 mg of 3,4-dimethyl-1,3-diazoline-2-thione, and subsequently 3mg of sodium thiosulfate and 1 mg of potassium chloroaurate. The resulting emulsion was heated at 70° C. over a period of 70 minutes to effect chemical sensitization. To the thus-chemically-sensitized core emulsion, in a similar manner to preparation of the core emulsion, 520 ml of a 1.47 mol/l silver nitrate solution and 520 ml of a 1.47 mol/l potassium bromide solution were added at a flow rate, which was increased so that the flow rate at the conclusion of addition was 5 times that at the beginning of addition, by a double jet method as the pBr at 70° C. was maintained at 2.6. The thus-prepared emulsion was washed by a conventional flocculation method, and thereto was added 50 g of dispersant gelatin to obtain 1,500 g of a core/shell emulsion. The diameter of the tabular grains obtained, i.e., the average diameter of circles having the same projected areas as these grains, was 2.2 μm, and their average thickness was 0.34 μm. The thus-obtained tabular grains contained the hexagonal tabular grains according to the invention in an amount of 70 wt % based on the total silver amount of the thus-obtained tabular grains, and the variation coefficient of these grains was 16%.

To this core/shell emulsion, 0.2 mg of sodium thiosulfate and 10 mg of poly(N-vinylpyrrolidone) (molecular weight: 20,000) were added, and heated at 60° C. for 50 minutes. Thus, the surfaces of the individual grains were chemically sensitized. (Emulsion A-2)

Preparation of Emulsion C-3:

Another core/shell emulsion was prepared in the same manner as emulsion A-2, except the pBr at 70° C. during shell formation on the chemically sensitized core emulsion grains was maintained at 1.5 instead of 2.6. The diameter of the tabular grains obtained, i.e., the average diameter of circles having the same projected areas as these grains, was 2.6 μm, and their average thickness was 0.13 μm. The surfaces of thus-obtained core/shell emulsion grains were chemically sensitized under the same conditions as in preparation of the foregoing emulsion A-2.

Preparation of Emulsion C-4 (Comparative Emulsion):

To a vigorously stirred 3 wt % aqueous gelatin solution, an aqueous water solution of potassium bromide and that of silver nitrate were added at 75° C. over a period of 60 minutes by a double jet process to form a monodisperse octahedral silver bromide emulsion. Before the precipitation, 3,4-dimethyl-1,3-thiazoline-2-thione and benzimidazole were added to the emulsion-making system in amounts of 100 mg and 15 g, respectively, per 1 mole of silver. At the conclusion of the precipitation, grains having an average diameter of about 0.9 μm were formed. The thus obtained emulsion grains were chemically sensitized by adding thereto 5.4 mg/mol Ag of sodium thiosulfate and 3.9 mg/mol Ag of potassium chloroaurate, and heating it at 75° C. for 80 minutes. To the thus chemically sensitized core emulsion were added an aqueous solution of potassium bromide and an aqueous solution of silver nitrate over a period of 40 minutes according to a double jet process under the same precipitation conditions as in the first stage to obtain a core/shell emulsion. The average diameter of the final emulsion grains was 1.5 μm. (Core/-shell direct positive octahedral silver bromide emulsion).

To this core/shell emulsion, sodium thiosulfate and poly(N-vinylpyrrolidone) were added in amounts of 0.32 mg and 57 mg, respectively, per 1 mole of silver, and heated at 60° C. over a period of 60 minutes to effect chemical sensitization at the grain surfaces. (Emulsion C-4)

Preparation of Photosensitives Sheet:

On a transparent polyethylene terephthalate film support (100 μm thick), were coated the layers described below in this order to prepare photosensitive sheets (A), (B) and (C).

(1) Mordanting layer containing 3.0 g/m$^2$ of gelatin and 3.0 g/m$^2$ of the polymer latex mordant illustrated below:

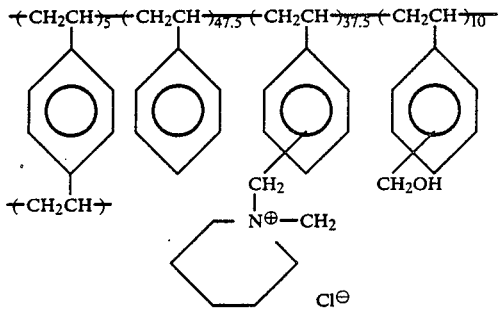

(Particle size: 0.10 μm)

(2) White reflecting layer containing 20 g/m² of titanium dioxide (paricle size: 0.30 μm) and 2.0 g/m² of gelatin.

(3) Opaque layer containing 2.0 g/cm² of carbon black (particle size: 0.03 μm) and 1.5 g/m² of gelatin.

(4) Layer containing 0.44 g/m² of the cyan dye releasing redox compound illustrated below, 0.09 g/m² of tricyclohexyl phosphate, 0.008 g/m² of 2,5-di-t-pentadecylhydroquinone and 0.8 g/m² of gelatin:

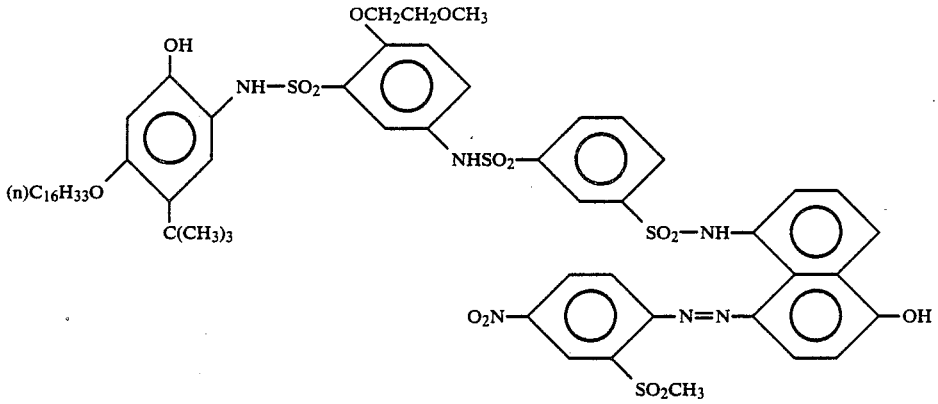

(5) Layer containing 1.5 g/m² of titanium dioxide (particle size: 0.30 μm) and 0.40 g/m² of gelatin.

(6) Red-sensitive emulsion layer containing a red-sensitive internal latent image type direct positive silver bromide emulsion, for which the foregoing emulsion A-2, C-3 or C-4 was used, (at a silver coverage of 1.03 g/m²), 1.2 g/m² of gelatin, 0.04 mg/m² of the nucleating agent illustrated below and 0.13 g/m² of the sodium salt of 2-sulfo-5-n-pentadecylhydroquinone:

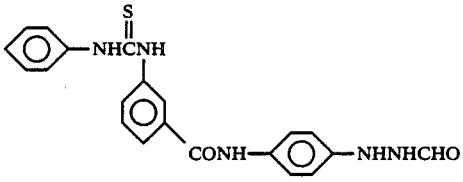

(7) Protective layer containing 1.0 g/m² of gelatin.

Preparation of Cover Sheet:

A cover sheet was prepared by coating on a transparent polyethylene terephthalate film support (100 μm thick) the following layers (1) to (4) in this order.

(1) Neutralizing layer containing 9.0 g/m² of acrylic acid/butylacrylate (8/2 by weight) copolymer having a mean molecular weight of 50,000 and 0.18 g/m² of 1,4-bis(2,3-epoxypropoxy)butane.

(2) Second neutralization timing layer containing 7.5 g/m² of a 95:5 (by weight) mixture of cellulose acetate having an acetylation degree of 51.0% (molecular weight: 30,000) and methylvinyl ether/monomethyl maleate alternate copolymer (molecular weight: 50,000), and 0.825 mmol/m² of 1,3-bis(2-(1-phenyl-5-tetrazolylthio) ethylsulfonyl)-2-propanol.

(3) Auxiliary neutralizing layer containing 0.735 g/m² of methylvinyl ether/maleic anhydride alternate copolymer (molecular weight: 30,000), 0.315 g/m² of styrene/maleic acid alternate copolymer (molecular weight: 60,000), and 0.45 g/m² of cellulose acetate having an acetylation degree of 55.0% (molecular weight: 150,000).

(4) First neutralization timing layer obtained by coating at a coverage of 2.5 g/m² on a total solids basis a polymer latex blend obtained by blending a polymer latex prepared by copolymerizing styrene, butylacrylate, acrylic acid and N-methylol acrylamide at a ratio of 49.7/42.3/4/4 by weight according to an emulsion polymerization process (particle size: 0.08 μm) with a polymer latex prepared by copolymerizing methylmethacrylate, acrylic acid and N-methylol acrylamide at a ratio of 93/3/4 by weight according to an emulsion polymerization process (particle size: 0.08 μm), so that the ratio of the first latex to the second latex was 6:4 on a solids basis.

| Composition of Processing Solution | |
|---|---|
| 1-p-Tolyl-4-hydroxymethyl-4-methyl-3-pyrazolidone | 14.0 g |
| Sodium t-butylhydroquinonesulfonate | 0.3 g |
| 5-Methylbenzotriazole | 3.5 g |
| Sodium Sulfite (anhydrous) | 0.2 g |
| Na salt of carboxymethyl cellulose | 58 g |
| Potassium hydroxide (28% aq. soln.) | 200 ml |
| Benzyl alcohol | 1.5 ml |
| Carbon black (particle size: 0.02~0.08 μm) | 150 g |
| Water | 685 ml |

0.8 g portions of the processing solution having the above-described composition were charged into pressure rupturable containers.

The above-described cover sheet and the foregoing photosensitive sheet were superposed upon each other in face-to-face relation and subjected to a $10^{-2}$ second exposure from the cover sheet side using a xenon flash lamp through a continuous gradation wedge. Thereafter, the foregoing processing solution was spread between the sheets in a layer 75 μm thick (with the aid of pressure-applying rollers). The processing was carried out at 25° C. After one hour from the spread of the processing solution, the cyan color density of the transferred image formed in the mordanting layer (image-receiving layer) was measured through the transparent support of the photosensitive sheet with a Macbeth reflection densitometer. The results obtained are shown in Table 5.

TABLE 5

| Sample No. | Emulsion | Dmax | Dmin | Sensitivity | Re-reversal Sensitivity (Sensitivity at D = 0.6) |
|---|---|---|---|---|---|
| 41 | A-2 | 2.5 | 0.26 | 150 | 10 |
| 41 | C-3 | 2.4 | 0.32 | 130 | 50 |
| 43 | C-4 | 2.4 | 0.35 | 100 | 100 |

As can be seen from the data in Table 5, the photosensitive sheet utilizing the emulsion prepared in accordance with the present invention had higher reversal sensitivity, lower re-reversal sensitivity and low Dmin.

In accordance with the present invention, enhancement of the maximum density of a direct positive image was achieved without increase of the minimum density. In addition, the present invention increased photographic speed, improved the graininess and heightened the gradation in the toe portion (that is, improved the sharpness).

Further, even when processed with exhausted processing solution, the method of the present invention had increased maximum density without increased minimum density, and enabled an decrease in developing time.

Furthermore, images having high reversal sensitivity, lower re-reversal sensitivity and low minimum density were obtained by applying the method of the present invention to color instant photography.

While the invention has been described in detail and with reference to specific embodiments thereof, it will be apparent to one skilled in the art that various changes and modifications can be made therein without departing from the spirit and scope thereof.

What is claimed is:

1. A method for forming a direct positive image comprising the step of developing with a surface developer an imagewise exposed photosensitive material comprising a support having thereon at least one photosensitive emulsion layer containing unprefogged silver bromide core/shell grains capable of forming an internal latent image; said at least one photosensitive emulsion layer comprising hexagonal tabular silver bromide core/shell grains in an amount of at least 30 wt %, based on the total silver amount of silver bromide grains therein; said hexagonal tabular grains having two parallel hexagonal faces, the ratio of the longest side to the shortest side of the hexagon being at most 2; the aspect ratio of said hexagonal tabular grains being from 2 to 8; and said hexagonal tabular grains having a monodisperse size distribution.

2. The method for forming a direct positive image as claimed in claim 1, wherein said at least one photosensitive emulsion layer comprises said hexagonal tabular silver bromide grains in an amount of at least 50 wt %, based on the total silver amount of silver bromide grains therein.

3. The method for forming a direct positive image as clamed in claim 1, wherein the ratio of the longest side to the shortest side of said hexagon is at most 1.5.

4. The method for forming a direct positive image as claimed in claim 1, wherein the aspect ratio of said tabular grains is from 5 to 8.

5. The method for forming a direct positive image as claimed in claim 1, wherein said hexagonal tabular grains have a variation coefficient of at most 20%.

6. The method for forming a direct positive image as claimed in claim 5, wherein said hexagonal tabular grains have a variation coefficient of at most 15%.

7. The method for forming a direct positive image as claimed in claim 6, wherein said hexagonal tabular grains have a variation coefficient of at most 10%.

8. The method for forming a direct positive image as claimed in claim 1, wherein said silver bromide grains have an average grain size of from 0.2 to 2.5 μm.

9. The method for forming a direct positive image as claimed in claim 1, wherein said silver bromide grains are core/shell silver bromide grains having a molar ratio of silver bromide in the core to silver bromide in the shell in a range of from 1:30 to 5:1.

10. The method for forming a direct positive image as claimed in claim 1, wherein said developing is conducted in the presence of a nucleating agent represented by formula (N-I):

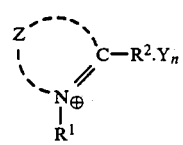

(N-I)

wherein Z represents a substituted or unsubstituted non-metallic atomic group necessary for forming a 5-membered or 6-membered ring; $R^1$ represents a substituted or unsubstituted aliphatic group; $R^2$ represents hydrogen, a substituted or unsubstituted aliphatic group or a substituted or unsubstituted aromatic group, provided that at least one of $R^1$, $R^2$ and Z comprises an alkinyl group, an acyl group, a hydrazinyl group or a hydrazonyl group, or $R^1$ and $R^2$ are linked to form a dihydropyridinium ring; Y represents a counter ion required for charge balance; and n is 0 or 1.

11. The method for forming a direct positive image as claimed in claim 1, wherein said developing is conducted in the presence of a nucleating agent represented by formula (N-II):

$$R^{21}-\underset{\underset{R^{23}}{|}}{N}-\underset{\underset{R^{24}}{|}}{N}-G-R^{22} \qquad \text{(N-II)}$$

wherein $R^{21}$ represents a substituted or unsubstituted aliphatic group, a substituted or unsubstituted aromatic group, or a substituted or unsubstituted heterocyclic group; $R^{22}$ represents hydrogen, a substituted or unsubstituted alkyl group, a substituted or unsubstituted aralkyl group, a substituted or unsubstituted aryl group, a substituted or unsubstituted alkoxy group, a substituted or unsubstituted aryloxy group, or a substituted or unsubstituted amino group; G represents a carbonyl group, a sulfonyl group, a sulfoxy group, a phosphoryl group, or an iminomethylene group; one of $R^{23}$ and $R^{24}$ represents hydrogen and the other represents hydrogen, a substituted or unsubstituted alkylsulfonyl group, a substituted or unsubstituted arylsulfonyl group, or a substituted or unsubstituted acyl group, provided that $R^{24}$ may represent a single bond to G.

12. The method for forming a direct positive image as claimed in claim 10, wherein said nucleating agent is contained in said photosensitive emulsion layer in an amount of from $10^{-8}$ to $10^{-2}$ mol per mol of silver halide therein.

13. The method for forming a direct positive image as claimed in claim 11, wherein said nucleating agent is contained in said photosensitive emulsion layer in an amount of from $10^{-8}$ to $10^{-2}$ mol per mol of silver halide therein.

14. The method for forming a direct positive image as claimed in claim 1, wherein said photosensitive material is a color photographic material capable of forming a direct positive image and said method further comprises the steps of:

(a) at least one of (i) bleaching and fixing and (ii) bleach-fixing said developed photosensitive material; and (b) at least one of (i) washing and (ii) stabilizing said fixed photosensitive material.

15. The method for forming a direct positive image as claimed in claim 13, wherein said surface developer has a pH of from 9 to 12.

* * * * *